US009903388B2

(12) United States Patent
Tsuruda et al.

(10) Patent No.: US 9,903,388 B2
(45) Date of Patent: Feb. 27, 2018

(54) CENTRIFUGAL PUMP

(71) Applicant: HONDA MOTOR CO., LTD., Tokyo (JP)

(72) Inventors: Kouki Tsuruda, Wako (JP); Masahiro Akiyama, Wako (JP); Kaku Okabe, Wako (JP)

(73) Assignee: HONDA MOTOR CO., LTD., Tokyo (JP)

( * ) Notice: Subject to any disclaimer, the term of this patent is extended or adjusted under 35 U.S.C. 154(b) by 313 days.

(21) Appl. No.: 14/810,549

(22) Filed: Jul. 28, 2015

(65) Prior Publication Data

US 2016/0032940 A1 Feb. 4, 2016

(30) Foreign Application Priority Data

Jul. 29, 2014 (JP) ..... 2014-154113

(51) Int. Cl.
*F04D 29/42* (2006.01)
*F04D 7/04* (2006.01)
*F04D 9/02* (2006.01)

(52) U.S. Cl.
CPC ..... *F04D 29/426* (2013.01); *F04D 7/04* (2013.01); *F04D 9/02* (2013.01); *F04D 29/4273* (2013.01)

(58) Field of Classification Search
CPC ..... F04D 29/4273; F04D 29/902; F04D 7/04; F04D 29/426
USPC ..... 415/204
See application file for complete search history.

(56) References Cited

U.S. PATENT DOCUMENTS

| | | | | |
|---|---|---|---|---|
| 2,292,529 A | | 8/1942 | La Bour | |
| 3,270,678 A | * | 9/1966 | La Monica | F04D 9/02 415/206 |
| 3,898,014 A | | 8/1975 | Meister et al. | |
| 4,355,950 A | | 10/1982 | Pollak | |
| 6,402,461 B1 | * | 6/2002 | Tebby | F04D 29/426 415/58.2 |

FOREIGN PATENT DOCUMENTS

| | | | | |
|---|---|---|---|---|
| EP | 1510696 A1 | * | 3/2005 | F04D 9/06 |
| JP | 50-021701 U | | 3/1975 | |
| JP | 03-267596 | | 11/1991 | |
| JP | 2013-057275 | | 3/2013 | |
| JP | 2013-057277 | | 3/2013 | |

OTHER PUBLICATIONS

Japanese Notice of Allowance with Partial English Translation dated Aug. 23, 2016, 4 pages.
European Search Report dated Dec. 6, 2016.
European Search Report dated Nov. 30, 2015, 7 pages.

* cited by examiner

*Primary Examiner* — Jason Shanske
*Assistant Examiner* — Alexander White
(74) *Attorney, Agent, or Firm* — Rankin, Hill & Clark LLP

(57) ABSTRACT

A centrifugal pump includes an impeller rotatably disposed in a volute case for forcing a fluid to flow along a volute internal flow channel formed in the volute case, and first to fourth flow-channel recessed portions opening to the volute internal flow channel. The first and fourth flow-channel recessed portions are formed so as to be recessed in a direction substantially orthogonal to a direction of flow of the fluid. In a self-priming operation, the fluid is introduced into the first and fourth recessed portions whereupon the prime fluid is stirred within internal spaces of the first and second flow-channel recessed portions.

2 Claims, 16 Drawing Sheets

48
35
35a
47
10
20
12
38
4
45a
27
34
13
37
41
43
33a
61
26
32
31
56
22
29
82a
44
86
28
33
A
14b
14
14a
82
86
16
17
82
26
82a
59
25
43a
45
84

CENTRIFUGAL PUMP

FIELD OF THE INVENTION

The present invention relates to a centrifugal pump configured to force a fluid to flow along a volute internal flow channel upon rotation of an impeller disposed in a volute case.

BACKGROUND OF THE INVENTION

Centrifugal pumps generally include a volute provided inside a casing, and an impeller provided on a rotating shaft projecting into the volute. The impeller has a hub mounted on the rotating shaft and a plurality of vanes provided on the hub. The impeller is disposed inside the volute. When the centrifugal pump is to be driven, a self-priming operation is performed to create a negative pressure inside the volute to thereby introduce a fluid, such as water, into the volute by the effect of the negative pressure.

By thus introducing the fluid via the self-priming operation, a steady operation becomes possible. In the steady operation, the fluid is first sucked into the volute, then guided outside the volute (i.e., inside the casing) by the effect of a centrifugal force of the impeller, and finally discharged from the casing to the outside. A typical example of such centrifugal pumps is disclosed in Japanese Patent Application Laid-open Publication (JP-A) No. 03-267596.

When the centrifugal pump disclosed in JP 03-267596 A performs a self-priming operation, a priming fluid is introduced in the volute and the impeller is rotated by driving the rotating shaft. Upon rotation of the impeller, the priming fluid introduced in the volute is guided by the impeller to flow along the volute to thereby force gas (air) in the volute to be discharged outside the volute. As a consequence of this operation, a negative pressure is created inside the volute and, by the effect of the negative pressure, the fluid is sucked into the volute. A steady operation of the centrifugal pump is now ready to be performed.

In a method known as a means for properly discharging gas in the volute to the outside of the volute, the prime fluid in the volute is stirred by utilizing vanes of the impeller. By thus stirring the prime fluid, the gas (in the form of air bubbles) contained in the prime fluid is separated from the prime fluid and discharged from the volute to the outside of the volute.

However, in order to stir the prime fluid in the volute by using the vanes of the impeller, distal ends of the vanes should be formed into a shape which is suitable for stirring the prime fluid. The shape of the distal ends of the vanes greatly contributes to the stirring of the prime fluid. Under these circumstances, the degree of freedom in designing the shape of the vanes' distal ends is considerably low, and sufficient elaborately measures cannot be taken to form the distal ends of the vanes into a shape which is suitable for performing a steady operation.

It is therefore an object of the present invention to provide a centrifugal pump which is capable of stirring a prime fluid and allows vanes to have distal ends formed into a shape suitable for a steady operation.

SUMMARY OF THE INVENTION

According to the present invention, there is provided a centrifugal pump comprising: a volute case having a volute internal flow channel formed therein; an impeller rotatably disposed in the volute case for forcing a fluid to flow along the volute internal flow channel; and at least one flow-channel recessed portion opening to the volute internal flow channel and formed so as to be recessed in a direction substantially orthogonal to a direction of flow of the fluid.

With this arrangement, since the flow-channel recess portion opens to the volute internal flow channel and is formed so as to be recessed in the direction orthogonal to the direction of flow of the fluid, at a time of performing a self-priming operation, gas (air) in the volute case is mixed (or entrained) with the prime fluid in a state of air bubbles. By virtue of the air bubbles contained in the prime fluid, the viscosity and density of the prime fluid are reduced so that the prime fluid can be easily introduced in an internal space of the flow-channel recessed portion.

The prime fluid introduced in the flow-channel recessed portion creates a vortex flow within the internal space of the flow-channel recessed portion and the prime fluid is eventually stirred in the internal space of the flow-channel recessed portion. By thus stirring the prime fluid, generation of the air bubbles is promoted, which will insure proper separation of the air bubbles from the prime fluid. The gas (in the form of air bubble thus separated from the prime fluid) can be properly discharged from the volute case to the outside and, hence, the self-priming performance can be achieved with enhanced efficiency.

Furthermore, because the flow-channel recessed portion is formed to open to the volute internal flow channel and the prime fluid is stirred within the internal space of the flow-channel recessed portion, it is not necessary to stir the prime fluid by distal ends of vanes of the impeller. The vanes are therefore allowed to have distal ends formed into a shape which is suitable for a steady operation. Since the flow-channel recessed portion is closed at a bottom thereof and hence has a blind-hole shape, the flow-channel recess portion is kept in the state of being filled with the fluid during the steady operation. This arrangement hinders further entry of the fluid into the internal space of the flow-channel recessed portion and allows the fluid to be smoothly guided along the volute internal flow channel without entering the flow-channel recessed portion. By virtue of the vanes having distal ends formed into a shape suitable for the steady operation and by the fluid allowed to smoothly flow during the steady operation, a desired pumping efficiency during the steady operation can be obtained.

Preferably, the flow-channel recessed portion has an opening which faces the volute internal flow channel, and a peripheral edge defining the opening, the peripheral edge having a straight section substantially orthogonal to the direction of flow of the fluid. By virtue of the straight section of the opening's peripheral edge, the opening is allowed to have a sufficiently large width as measured in a direction orthogonal to the direction of flow of the fluid. By thus providing the sufficiently large opening width, the prime fluid can be appropriately guided from the opening into the internal space of the flow-channel recessed portion, and the thus guided prime fluid is able to appropriately create a vortex flow within the internal space of the flow-channel recessed portion. The vortex flow effectively promotes generation of air bubbles from the prime fluid, which will lead to appropriate separation of the air bubbles from the prime fluid. By thus separating the air bubbles from the prime fluid, the gas in the volute internal flow channel can be appropriately discharged to the outside. The self-priming performance can thus be achieved with enhanced efficiency The straight section of the opening's peripheral edge may be provided on both an upstream side and a downstream side as viewed from the direction of flow of the fluid, or alternately, on only one of the upstream side and the downstream side. In the case where the straight section is provided on both the upstream side and the downstream side of the opening's peripheral edge, it is possible to provide an opening width which is large enough to secure smooth entry of the prime fluid from the opening into the internal space of the flow-channel recessed portion and enhanced generation of a vortex flow within the internal space of the flow-channel recess portion.

In the case where the straight section is provided on one of the upstream side and the downstream side of the opening's peripheral edge, it is preferable to provide the straight section on the upstream side for the purpose of achieving proper guiding of the prime fluid from the opening into the internal space of the flow-channel recessed portion. More specifically, if the peripheral edge of the opening is formed into a curved shape, the curved peripheral edge section will fail to introduce the prime fluid into the internal space of the flow-channel recessed portion uniformly over the entire width thereof. More specifically, a part of the prime fluid tends to first enter the internal space of the flow-channel recessed portion and this prime-fluid part is restrained from flowing into the internal space of the flow-channel recessed portion due to, for example, the viscosity of that part of the prime fluid which tends to later enter the internal space of the flow-channel recess portion. It is therefore difficult to properly introduce the prime fluid from the opening into the internal space of the flow-channel recessed portion.

By contrast, the straight peripheral edge section provided on the upstream side allows entry of the prime fluid from the straight peripheral edge section into the internal space of the flow-channel recessed portion uniformly over the width thereof. The prime fluid can thus be introduced from the opening into the internal space of the flow-channel recessed portion in an appropriate manner, and the introduced prime fluid can properly generate a vortex flow within the internal space of the flow-channel recessed portion.

Preferably, the flow-channel recessed portion has a part formed to protrude from the volute internal flow channel in a radial outward direction of the impeller. With this arrangement, the flow-channel recessed portion includes a first part (hereinafter referred to as "an inner flow-channel recess part") corresponding in position to the volute internal flow channel, and a second part (hereinafter referred to as "an outer flow-channel recessed part") arranged to protrude from the volute internal flow channel in the radial outward direction of the impeller. The prime fluid, as it flows along the volute internal flow channel, is subjected to a centrifugal force. The prime fluid introduced in an internal space of the inner flow-channel recessed part is subsequently introduced in the form of a vortex flow into an internal space of the outer flow-channel recessed part by the effect of the centrifugal force. Generation of the vortex flow by the prime fluid can be promoted, which will further promote generation of air bubbles.

In one preferred form of the invention, the number of the flow-channel recessed portion is plural, and the respective parts of the plural flow-channel recessed portions, which are arranged to protrude from the volute internal flow channel in the radial outward direction of the impeller, are set to be successively smaller along the direction of flow of the fluid. This arrangement ensures that an endmost one of the protruding parts which is located adjacent to a trailing end of the volute case is made sufficiently large, and another endmost protruding part located adjacent to a leading end of the volute case is made sufficiently small. The sufficiently large protruding part effectively promotes generation of a vortex flow by the prime fluid (i.e., stirring of the prime fluid) which will promote generation of air bubbles from the prime fluid.

On the other hand, the sufficiently small protruding part located adjacent to the leading end of the volute case is able to appropriately suppress generation of the vortex flow by the prime fluid (i.e., stirring of the prime fluid). The prime fluid guided to a leading end of the volute internal flow channel is smoothly discharged from the leading end of the volute internal flow channel. This will provide a high prime-fluid pumping performance. By virtue of a combination of the enhanced generation of air bubbles on the trailing end side of the volute internal flow channel and the suppressed generation of the vortex flow on the trailing end side of the volute internal flow channel, the gas in the volute internal flow channel can be appropriately discharged to the outside and a further improvement in the self-priming performance can be achieved.

DETAILED DESCRIPTION OF THE PREFERRED EMBODIMENT

A certain preferred structural embodiment of the present invention will be described in greater details below, by way of example only, with reference to the accompanying sheets of drawings.

Figure 1:
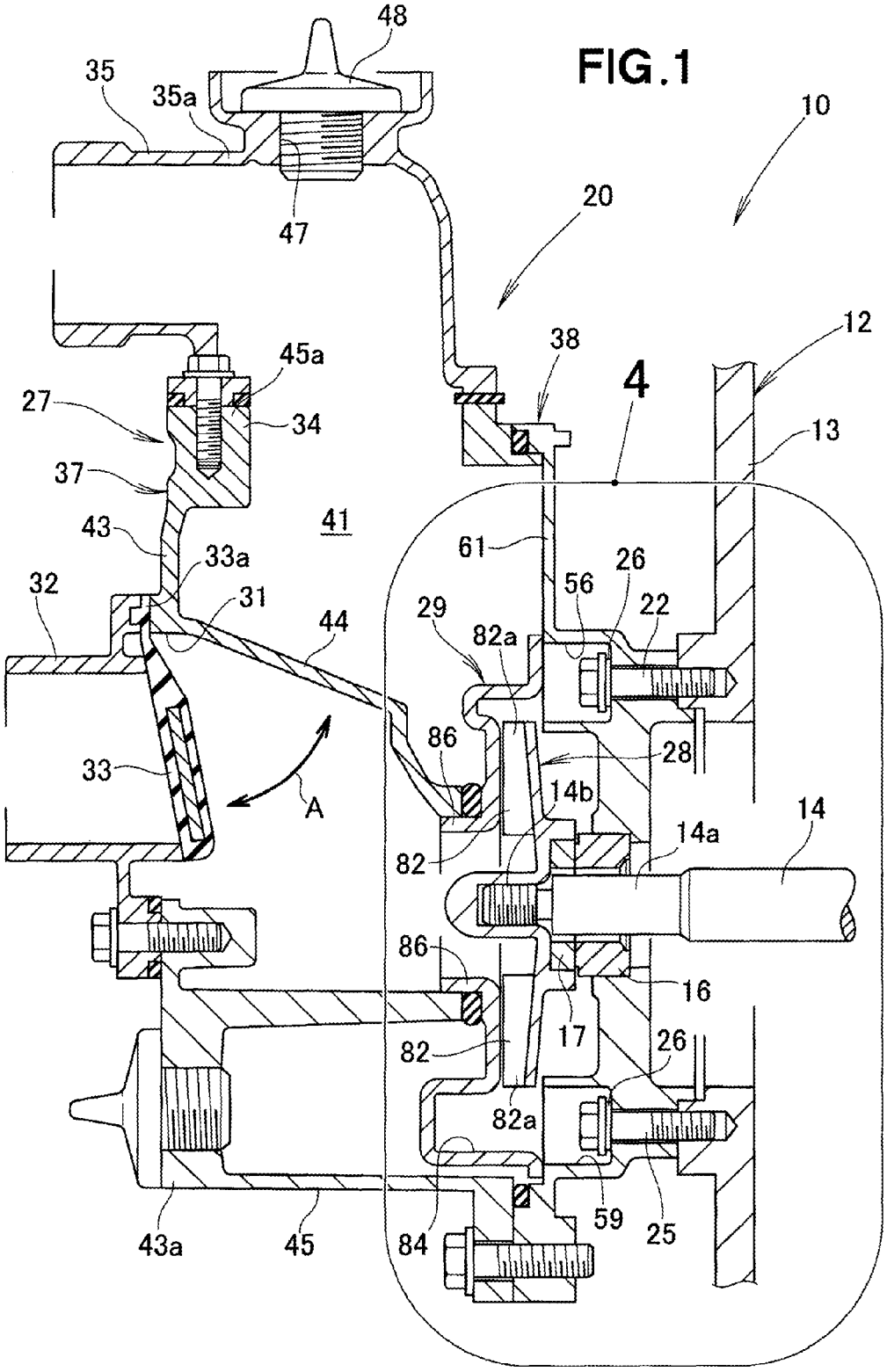
FIG. 1 is a cross-sectional view of a centrifugal pump unit according to a preferred embodiment of the present invention.

As shown in FIG. 1, a centrifugal pump unit 10 generally comprises a base (not shown) supporting the centrifugal pump unit 10, an engine 12 including a cylinder block 13 mounted on the base, and a centrifugal pump 20 provided on the cylinder block 13 of the engine 12.

The engine 12 includes the cylinder block 13 mounted on the base, and a crankshaft (output shaft) 14 rotatably supported inside the cylinder block 13. The centrifugal pump 20 has a case member 27 (especially, a partition member 38 of the case member 27) mounted to the cylinder block 13 by first to fourth bolts 22-25 (the second and third bolts 23, 24 being shown in FIG. 5). A sealing washer 26 is disposed between each of the bolts 22-25 and the partition member 38 (especially, a volute support wall 61 of the partition member 38).

The crankshaft 14 has an end portion 14*a* projecting outwardly from the cylinder block 13, and the end portion 14*a* is connected at its distal end 14*b* with an impeller 28 of the centrifugal pump 20. With this arrangement, when the engine 12 is driven to rotate the crankshaft 14, the impeller 28 is rotated by the crankshaft 14. The case member 27 and the impeller 28 of the centrifugal pump 20 are sealed by mechanical seals 16, 17.

Figure 2:
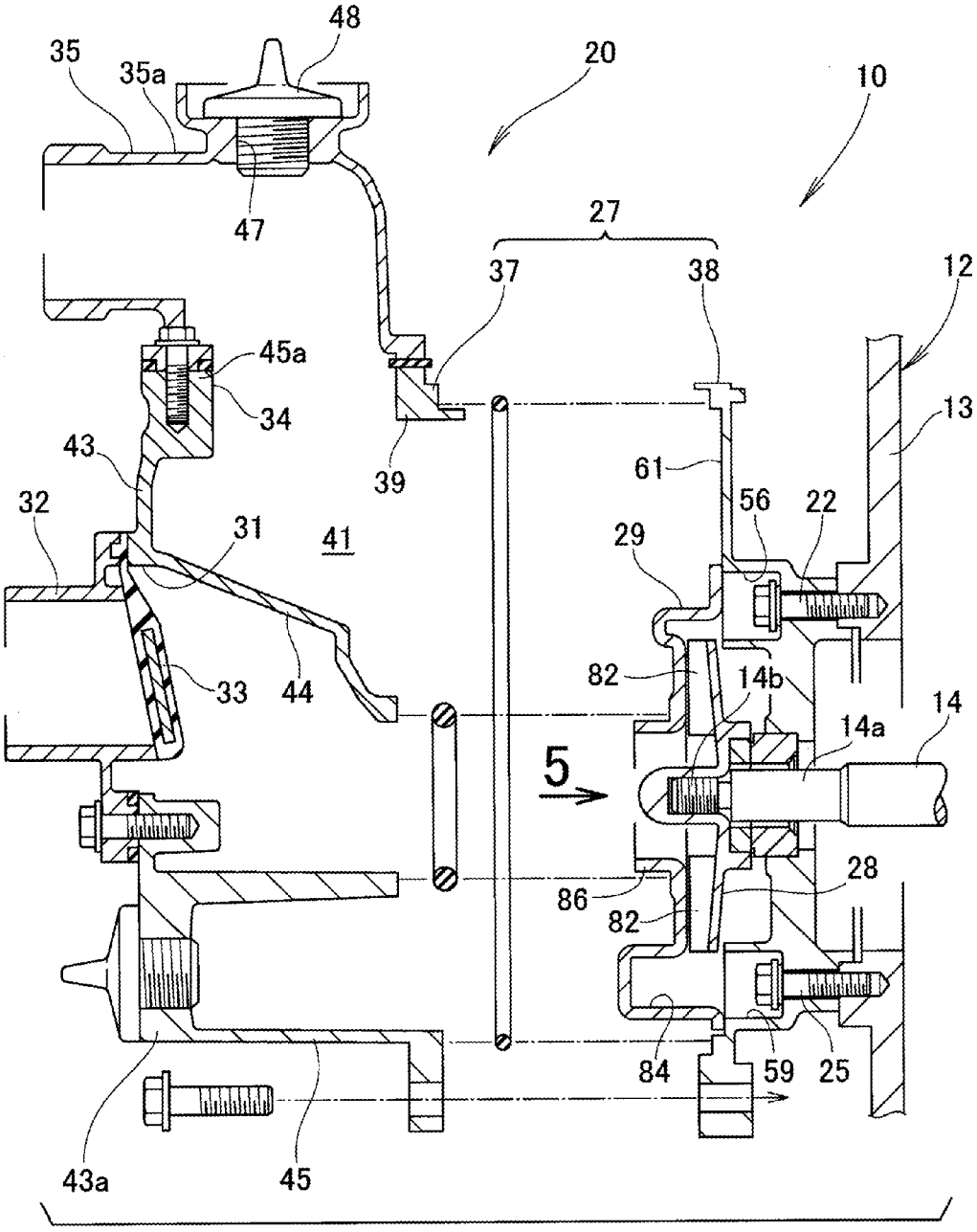
FIG. 2 is a cross-sectional view of the centrifugal pump unit shown in a disassembled state.
Figure 3:
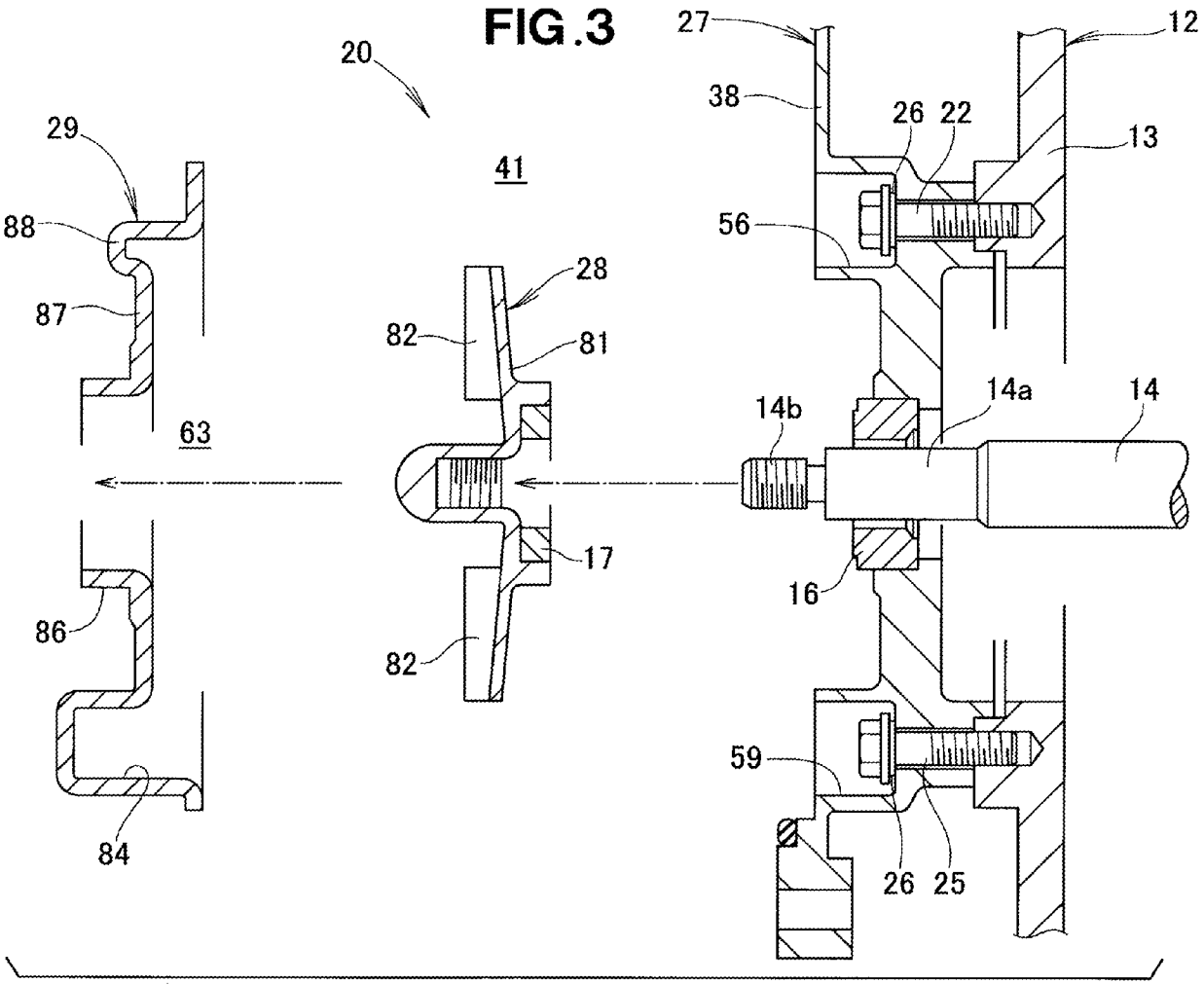
FIG. 3 is a cross-sectional view of a volute case and an impeller of the centrifugal pump unit as there are in a disassembled state.

As shown in FIGS. 2 and 3, the centrifugal pump 20 includes the case member 27 bolted to the cylinder block 13 by the first to fourth bolts 22-25, the impeller 28 disposed inside the case member 27 and connected to the distal end 14*b* of the crankshaft 14, and a volute case 29 covering the impeller 28. The centrifugal pump 20 further includes a suction nozzle 32 connected with a suction port or inlet 31 (FIG. 1) of the case member 27, an opening and closing valve 33 having an upper end 33*a* gripped between the case member 27 and the suction nozzle 32, and a discharge nozzle 35 connected with a discharge port or outlet 34 of the case member 27.

The case member 27 includes a casing body 37 accommodating therewithin the impeller 28 and the volute case 29, and the partition member 38 closing an open end 39 of the casing body 37. The open end 39 of the casing body 37 is closed by the partition member 38, and the volute case 29 is provided on the partition member 38. With this arrangement, the casing body 37, the partition member 38 and the volute case 29 jointly define therebetween an internal flow channel 41. The internal flow channel 41 has an annular shape formed between the case member 27 and the volute case 29 within the case member 27.

The casing body 37 includes the open end 39 closed by the partition member 38, a substantially disc-shaped suction-side end wall 43 opposed to the partition wall 38, the suction port 31 formed in the suction-side end wall 43, a suction passage 44 connected to the suction port 31, a tubular peripheral wall 45 formed along an outer peripheral edge 43*a* of the suction-side end wall 43, and the discharge port 34 formed at an upper part 45*a* of the peripheral wall 45.

Referring back to FIG. 1, the suction port 31 is formed in the suction-side end wall 43 and the suction passage 44 is connected to the suction port 31. The suction passage 44 is also connected to a suction port or inlet 86 of the volute case 29. The suction port 86 will be hereinafter referred to as "volute suction port". The discharge port 34 of the case member 27 is provided at the upper part 45*a* of the peripheral wall 45, and the discharge nozzle 35 is connected to the discharge port 34. A fluid supply port 47 is formed in an upper part 35*a* of the discharge nozzle 35, and the fluid supply port 47 is closed by a supply plug 48. The fluid supply port 47 is disposed above the volute case 29.

Figure 4:
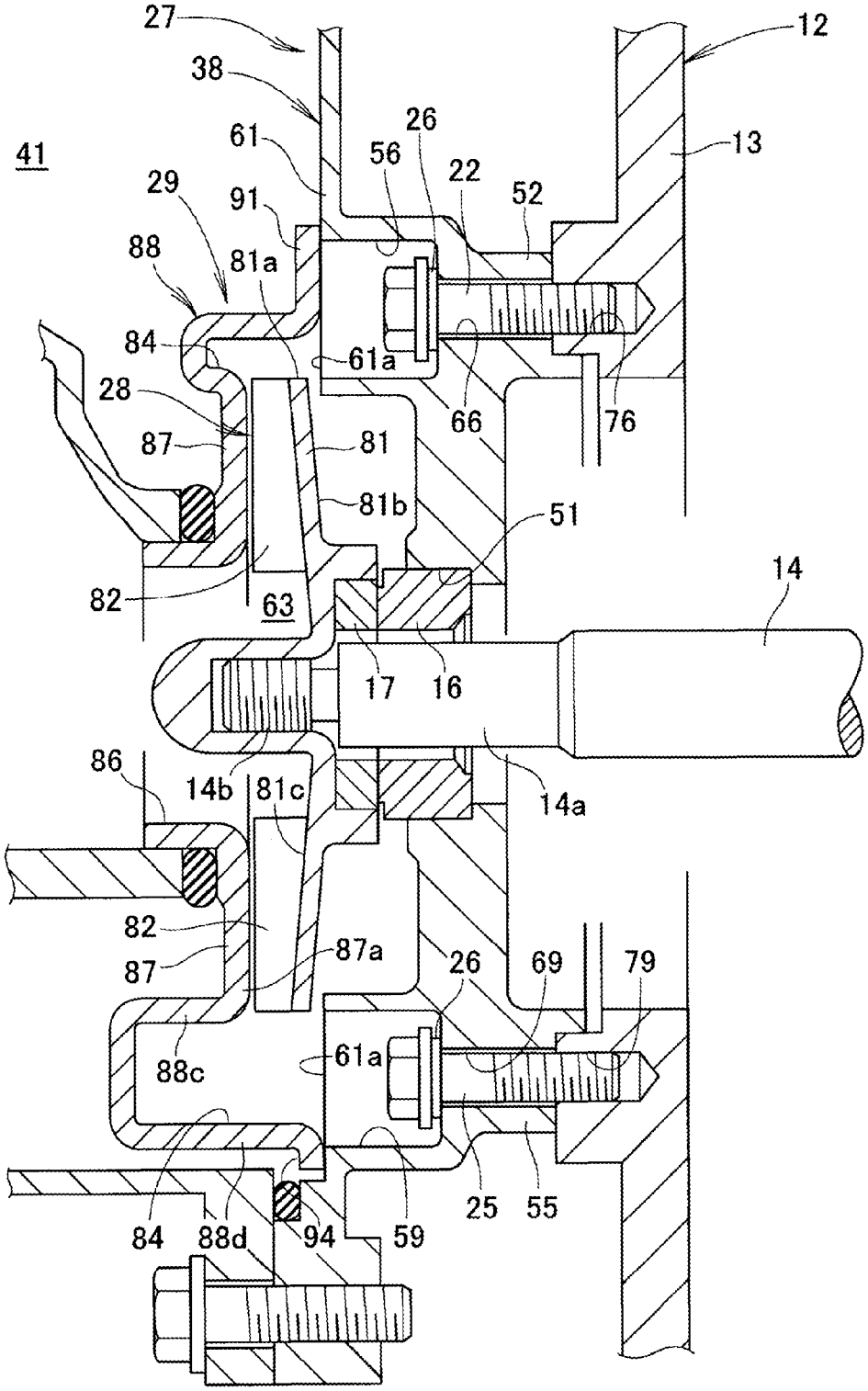
FIG. 4 is an enlarged view of a part indicated by an elongated circle 4 shown in FIG. 1.
Figure 5:
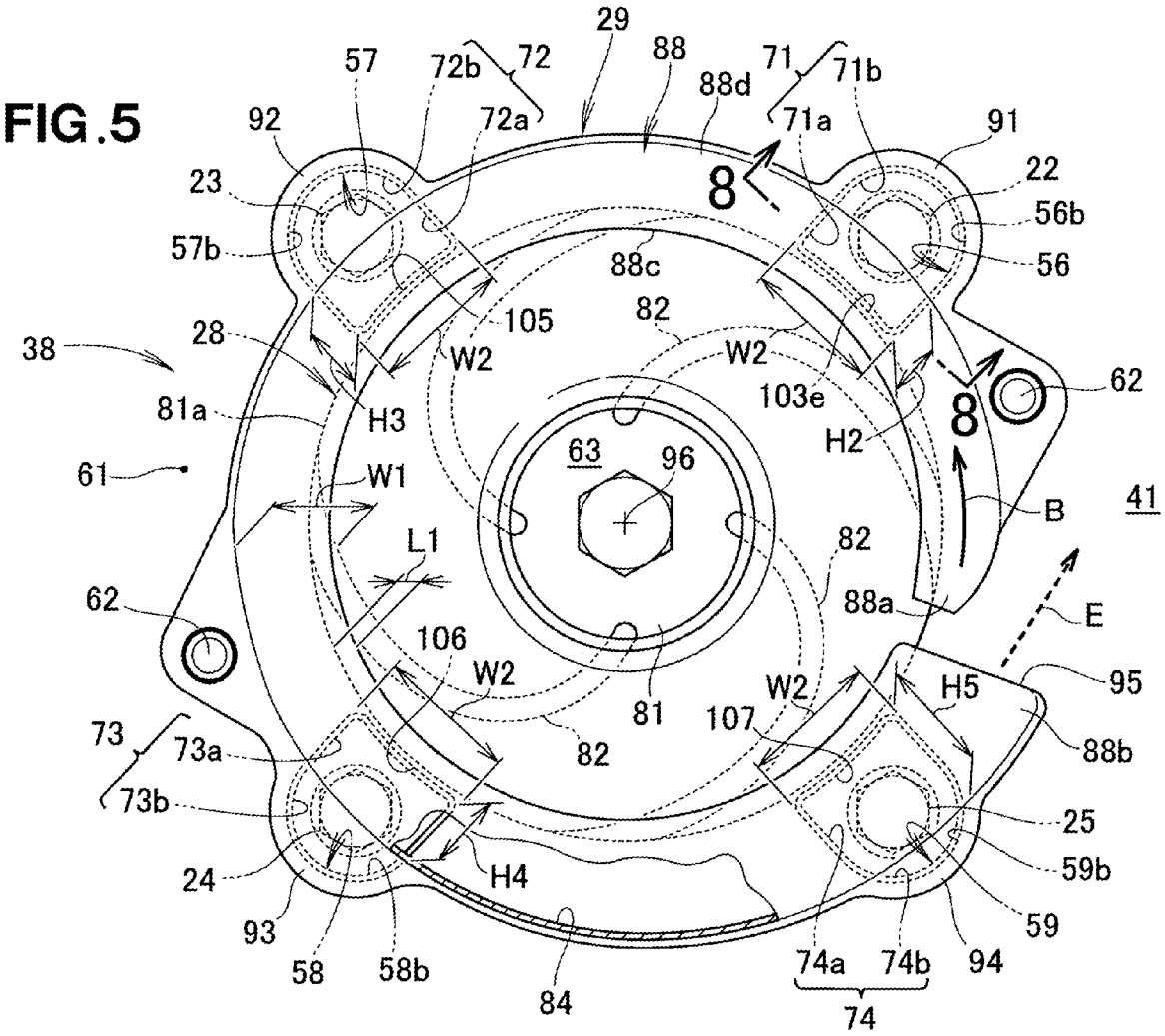
FIG. 5 is a view in the direction of arrow 5 shown in FIG. 2.

As shown in FIGS. 4 and 5, the partition member 38 has a support hole 51 formed through a thickness of the partition member 38 in concentric relation to the crankshaft 14, first to fourth cylinder attachment portions 52-55 (the second and third cylinder attachment portions 53, 54 being shown in FIG. 5) disposed at equal circumferential intervals on a circle concentric with the support hole 51, first to fourth flow-channel recessed portions 56-59 formed at positions corresponding to positions of the first to fourth cylinder attachment portions 52-54, and the volute support wall 61 supporting the volute case 29.

The mechanical seal 16 is concentrically supported in the support hole 51 of the partition member 38. The end portion 14*a* of the crankshaft 14 projects through the mechanical seal 16 into an internal space 63 of the volute case 29. The mechanical seal 16 is in contact with the mechanical seal 17 of the impeller 28 so that a seal is mechanically provided between the mechanical seal 16 and the mechanical seal 17.

Figure 6:
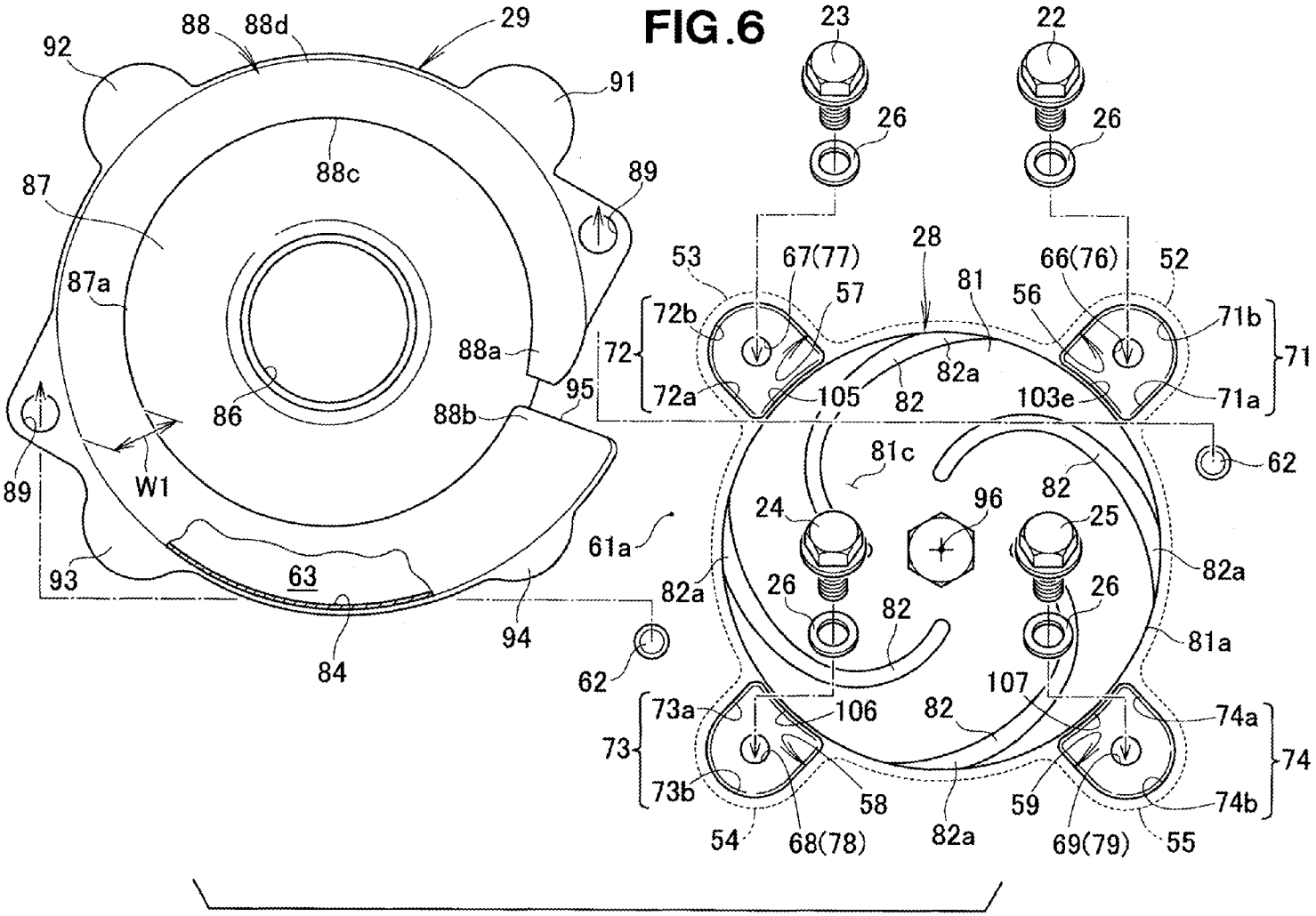
FIG. 6 is a plan view of the volute case disassembled from a volute support wall.

As shown in FIG. 6, the first to fourth cylinder attachment portions 52-55 are provided equidistantly on the circle concentric to the support hole 51 in the order from a trailing end 88*a* toward a leading end 88*b* of the volute case 29 (especially, a volute body 88 of the volute case 29). The first to fourth cylinder attachment portions 52-55 have first to fourth through-holes 66-69 opening at the first to fourth flow-channel recessed portions 56-59, respectively. The first to fourth flow-channel recessed portions 56-59 have first to fourth openings 71-74, respectively, that open at an inner surface of the volute support wall 61 and are located at positions corresponding to the respective positions of the first to fourth cylinder attachment portions 52-55.

Referring back to FIG. 5, the first opening 71 has a first inner opening part 71*a* facing a volute internal flow channel 84 described later, and a first outer opening part 71*b* located on a radial outer side of the volute internal flow channel 84. Similarly, the second opening 72 has a second inner opening part 72*a* facing the volute internal flow channel 84, and a second outer opening part 72*b* located on a radial outer side of the volute internal flow channel 84. The third opening 73 has a third inner opening part 73*a* facing the volute internal flow channel 84, and a third outer opening part 73*b* located on a radial outer side of the volute internal flow channel 84. Similarly, the fourth opening 74 has a four inner opening part 74*a* facing the volute internal flow channel 84, and a fourth outer opening part 74*b* located on a radial outer side of the volute internal flow channel 84. The first to fourth flow-channel recessed portions 56-59 and the first to fourth openings 71-74 will be described in greater detail below.

As shown in FIGS. 4 and 6, the first bolt 22 is inserted from the first flow-channel recessed portion 56 into the first through-hole 66 in the first cylinder attachment portion 52, and the first bolt 22 is threadedly engaged with a first attachment screw 76 formed in the cylinder block 13. Similarly, the second bolt 23 is inserted from the second flow-channel recessed portion 57 into the second through-hole 67 in the second cylinder attachment portion 53, and the second bolt 23 is threadedly engaged with a second attachment screw 77 formed in the cylinder block 13.

Furthermore, the third bolt 24 is inserted from the third flow-channel recessed portion 58 into the third through-hole 68 in the third cylinder attachment portion 54, and the third bolt 24 is threadedly engaged with a third attachment screw 78 formed in the cylinder block 13. Similarly, the fourth bolt 25 is inserted from the fourth flow-channel recessed portion 59 into the fourth through-hole 69 in the fourth cylinder attachment portion 55, and the fourth bolt 25 is threadedly engaged with a fourth attachment screw 79 formed in the cylinder block 13. The first to fourth cylinder attachment portions 52-55 are attached to the cylinder block 13 by the first to fourth bolts 22-25. In this state, the distal end 14*b* of the crankshaft 14 is arranged to project into the internal space 63 of the volute case 29 and the impeller 28 is attached to the distal end 14*b* of the crankshaft 14.

Respective heads of the first to fourth bolts 22-25 are received inside the first to fourth flow-channel recessed portions 56-59, respectively. The first to fourth bolts 22-25 can thus be set at positions corresponding to the position of the volute internal flow channel 84 without affecting the pump performance. This arrangement will lead to an improved degree of freedom in fastening the centrifugal pump 20 to the engine 12. Furthermore, the first to fourth flow-channel recessed portions 56-59 are formed by utilizing parts of the case member 27 which are bolted by the first to fourth bolts 22-25. The first to fourth flow-channel recessed portions 56-59 can thus be formed without requiring separate parts, which will cause compactification of the centrifugal pump 20.

The impeller 28 is disposed in the internal space 63 of the volute case 29. The impeller 28 includes a hub 81 mounted on the distal end 14*b* of the crankshaft 14, and a plurality of vanes 82 provided on the hub 81. The hub 81 is formed into a circular disc and an outer periphery 81*a* of the hub 81 is formed into a circular-arc shape. The hub 81 has a rear surface 81*b* (which faces the engine 12) on which the mechanical seal 17 is provided. The vanes 82 are provided on a front surface 81*c* of the hub 81. The impeller 28 is received in the internal space 63 of the volute case 29 and covered by the volute case 29.

The volute case 29 is supported on the volute support wall 38 by a pair of support pins 62. The volute case 29 is a casing which is disposed inside the case member 27 and configured to accommodate the impeller 28. The volute case 29 and the volute support wall 61 cooperate with each other to ensure that the volute internal flow channel 84 is formed in the internal space 63 of the volute case 29. More specifically, the volute body 88 of the volute case 29 and a wall part (hereinafter referred to as "volute wall part") 61*a* of the volute support wall 61 which is opposed to the volute body 88 together form the volute internal flow channel 84 into a hollow shape. The volute wall part 61*a* is formed spirally in confrontation with the volute body 88.

The volute case 29 includes the volute suction port 86 communicating with the suction passage 44 of the case body 37, a circular disc-shaped volute wall 87 extending radially outward from the volute suction port 86, the volute body 88 formed into a spiral shape around the volute wall 87, a pair of pin-insertion holes 89 fitted with the pair of support pins 62, respectively, and first to fourth projecting parts 91-94 that cover corresponding ones of the outer opening parts 71*b*-74*b* of the first to fourth openings 71-74. The volute wall 97 is circular-disc-shape so as to be opposed with the vanes 82 of the impeller 28. The volute body 88 is provided along an outer periphery of the volute wall 87 so that the volute body 88 is disposed on a radial outer side of an outer periphery of the impeller 28.

The volute body 88 is generally J-shaped in cross section. In the front view, the volute body 88 includes the trailing end 88*a* provided on a right side thereof, the leading end 88*b* provided adjacently below the trailing end 88*a*, an inner peripheral wall 88*c* extending arcuately from the trailing end 88*a* to the leading end 88*b* along the outer periphery 87*a* of the volute wall 87, and an outer peripheral wall 88*d* extending spirally from the trailing end 88*a* to the leading end 88*b* on a radial outer side of the inner peripheral wall 88*c*.

The inner peripheral wall 88*c* is formed into a circular arc which is concentric with a center 96 of the impeller 28 (i.e., the axis of the crankshaft 14). The outer peripheral wall 88*d* is formed into a spiral shape which is gradually separated from the inner peripheral wall as it goes in a counterclockwise direction from the trailing end 88*a* to the leading end 88*b*.

More specifically, the volute body 88 is formed into a counterclockwise spiral shape from the trailing end 88*a* to the leading end 88*b* such that a volute width W1 increases gradually in a direction from the trailing end 88*a* to the leading end 88*b*. The volute body 88 has a volute discharge port 95 formed at the leading end 88*b*. With this arrangement, the fluid (including the prime fluid) introduced in the internal space 63 of the volute case 29 is discharged from the volute discharge port 95 to the outside (i.e., the case internal flow channel 41).

In the self-priming operation, the prime fluid introduced in the volute internal flow channel 84 is discharged from the volute discharge port 95 into the case internal flow channel 41 together with a gas (an air bubble) in the volute internal flow channel 84. In the steady operation, the fluid introduced from the volute suction port 86 into the volute internal flow channel 84 is discharged from the volute discharge port 95 into the case internal flow channel 41.

As shown in FIGS. 5 and 6, the first to fourth projecting parts 91-94 projects radially outward from the outer peripheral wall 88*d* of the volute body 88. The first projecting part 91 covers and closes the first outer opening part 71*b* of the first opening 71. Similarly, the second projecting part 92 covers and closes the second outer opening part 72*b* of the second opening 72. Further, the third projecting part 93 covers and closes the third outer opening part 73*b* of the third opening 73. Similarly, the fourth projecting part 94 covers and closes the fourth outer opening part 74*b* of the fourth opening 74.

As shown in FIG. 1, the upper end 33*a* of the opening and closing valve 33 is gripped between the case member 27 and the suction nozzle 32. With the upper end 33*a* being gripped between the case member 27 and the suction nozzle 32, the opening and closing valve 33 is pivotally supported to undergo pivotal movement about the upper end 33 between a closed position in which the suction nozzle 32 is closed by the valve 33 and an opened position in which the suction nozzle 32 is opened by the valve 33.

The discharge nozzle 35 is disposed above the volute case 29. The discharge nozzle 35 is provided with the fluid supply port 47 such that the fluid supply port 47 is located above the volute case 29. The fluid supply port 47 is closed by the supply plug 48. The fluid supply port 47 is opened when the supply plug 48 is removed from the fluid supply port 47. While the fluid supply port 47 is in the opened state, the prime fluid is supplied from the fluid supply port 47 into the case internal flow channel 41. The prime fluid is such a fluid which can exhibit a priming action when the centrifugal pump performs self-priming operation.

Figure 7:
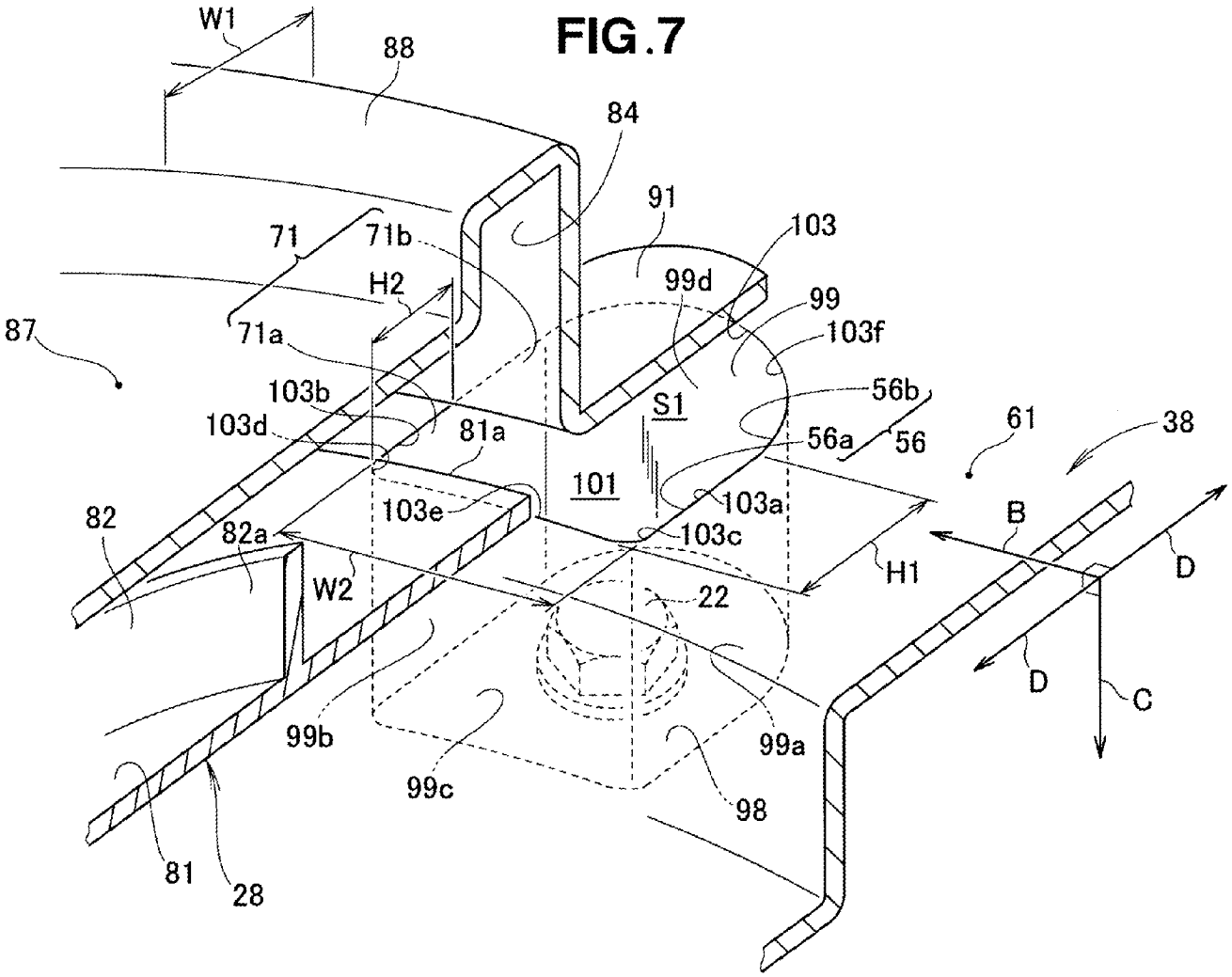
FIG. 7 is a perspective view showing the volute case and a first flow-channel recessed portion shown in FIG. 5.
Figure 8:
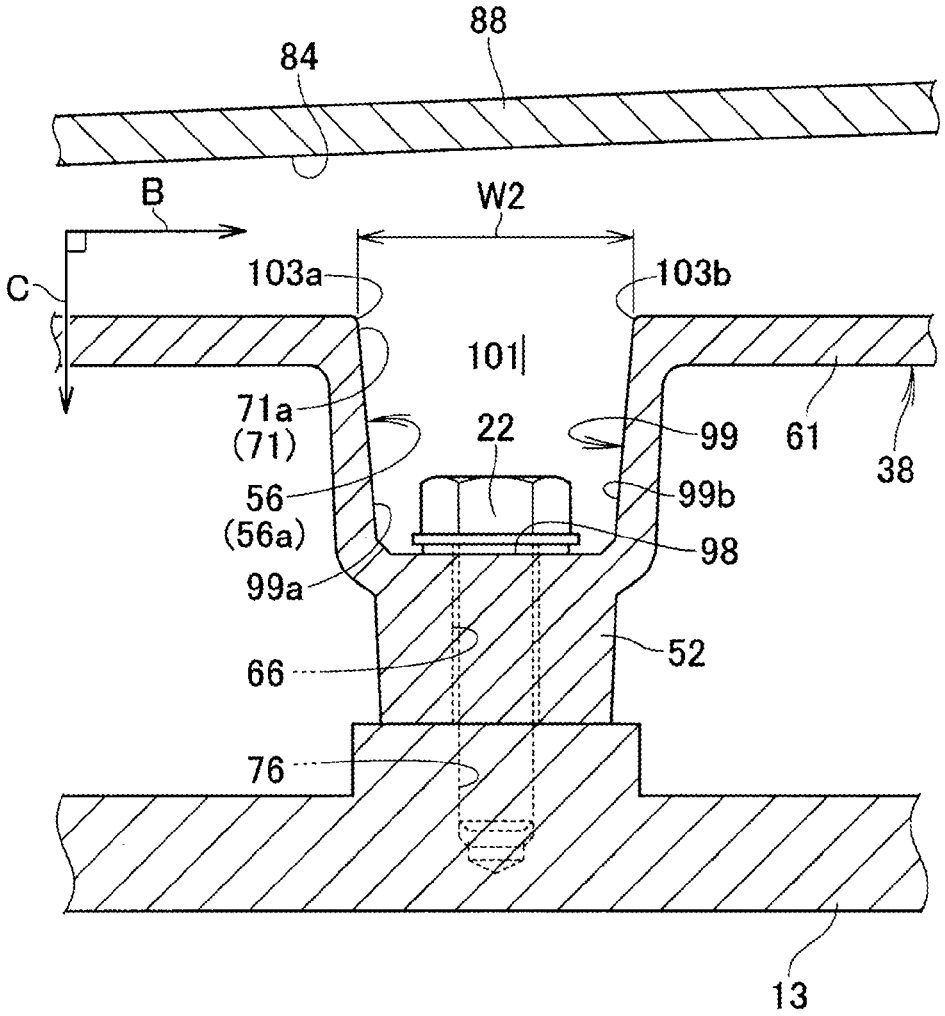
FIG. 8 is a cross-sectional view taken along line 8-8 of FIG. 5.

Next, the first to fourth flow-channel recessed portions 56-59 and the first to fourth openings 71-74 that are shown in FIG. 6 will be described below in greater detail. As shown in FIGS. 7 and 8, the first flow-channel recessed portion 56 is formed in such a manner as to correspond to the first cylinder attachment portion 52 of the partition member 38. The first flow-channel recessed portion 56 is formed such that the first inner opening part 71*a* of the first opening 71 opens to the volute internal flow channel 84, and is recessed toward the cylinder block 13 in a direction (of arrow C) substantially orthogonal to a direction of flow (direction of arrow B) of the fluid including the prime fluid.

More specifically, the first flow-channel recessed portion 56 has a bottom 98 forming a seat for the head of the first bolt 22, a first peripheral wall 99 extending from the bottom 98 to the volute support wall 61, and the first opening 71 at which an internal space 101 of the first flow-channel recessed portion 56 opens to the volute internal flow channel 84. The bottom 98 is formed to have an outline or contour which, in a plan view, is slightly smaller than a first peripheral edge 103 of the first opening 71. The first flow-channel recessed portion 56 is in the form of a blind hole which is closed at the bottom 98 and opens at the first opening 71. The first bolt 22 is inserted through the through-hole 66 of the first cylinder attachment portion 52 and threadedly engaged with the first attachment screw 76 in the cylinder block until the head of the first bolt 22 is seated on the bottom 98 of the first flow-channel recessed portion 56.

The first peripheral wall 99 includes an upstream peripheral wall portion 99*a* located on an upstream side with respect to the direction of flow of the fluid (indicated by arrow B), a downstream peripheral wall portion 99*b* disposed downstream of the upstream peripheral wall portion 99*a*, an inner peripheral wall portion 99*c* connecting an outer end of the upstream peripheral wall portion 99*a* and an outer end of the downstream peripheral wall portion 99*b*, and an outer peripheral wall portion 99*d* connecting an inner end of the upstream peripheral wall portion 99*a* and an inner end of the downstream peripheral wall portion 99*b*.

The first opening 71 has an outline or contour formed by the first peripheral edge 103. The first peripheral edge 103 is formed into a portal arch shape at a corner edge formed between the first peripheral wall 99 and the volute support wall 61. The first peripheral edge 103 includes an upstream straight section 103*a* located on an upstream side with respect to the direction of flow of the fluid (indicated by arrow B), a downstream straight section 103*b* disposed downstream of the upstream straight section 103*a*, an inner connecting section 103*e* connecting an inner end 103*c* of the upstream straight section 103*a* and an inner end 103*d* of the downstream straight section 103*b*, and an outer connecting section 103*f* connecting an outer end of the upstream straight section 103*a* and an outer end of the downstream straight section 103*b*.

The upstream straight section 103*a* is formed by a corner edge formed between the upstream peripheral wall portion 99*a* and the volute support wall 61. The upstream straight section 103*a* and the upstream peripheral wall portion 99*a* extend linearly in a direction substantially orthogonal to the direction of flow of the fluid (i.e., in a direction toward the outside of the volute body 88) within a range H1. Furthermore, the inner end 103*c* of the upstream straight section 103*a* and the inner end of the upstream peripheral wall portion 99*a* are located adjacent to the outer periphery 81*a* of the hub 81.

The downstream straight section 103*b* is formed by a corner edge formed between the downstream peripheral wall portion 99*b* and the volute support wall 61. The downstream straight section 103*b* and the downstream peripheral wall portion 99*b* extend linearly in the direction (of arrow C) orthogonal to the direction of flow of the fluid within the range H1, in the same manner as the upstream straight section 103*a* and the upstream peripheral wall portion 99*a*. The inner end 103*d* of the downstream straight section 103*d* and the inner end of the downstream peripheral wall portion 99*b* are located adjacent to the outer periphery 81*a* of the hub 81.

The distance between the upstream straight section 103*a* and the downstream straight section 103*b* is an opening width W2 of the first opening 71. The upstream straight section 103*a* and the downstream straight section 103*b* extend parallel to each other almost throughout the range H1 and, hence, the opening width W2 of the first opening 71 is constant almost throughout the range H1.

The inner connecting section 103*e* is formed by a corner edge formed between the inner peripheral wall portion 99*c* and the volute support wall 61. The inner connecting section 103*e* is connected with the inner end 103*c* of the upstream straight section 103*a* and the inner end 103*d* of the downstream straight section 103*b*. The inner connection section 103*e* is disposed at a position located radially outward of, and adjacent to, the outer periphery 81*a* of the hub 81. The inner connecting section 103*e* is formed into a circular arc shape which is concaved toward a center of the first opening 71 along the outer periphery 81*a* of the bub 81. Likewise the inner connecting section 103*e*, the inner peripheral wall portion 99*c* is formed into a circular-arc shape recessed toward a central axis of the opening 71 along the outer periphery 81*a* of the hub 81.

The outer connecting section 103*f* is formed by a corner edge formed between the outer peripheral wall portion 99*d* and the volute support wall 61. The outer connecting portion 103*f* is connected to the outer end of the upstream straight section 103*a* and the outer end of the downstream straight section 103*b*. Further, the outer connecting section 103*f* is formed into a curved shape which makes the first opening 71 to swell in a radial outward direction. Likewise the outer connecting section 103*f*, the outer peripheral wall portion 99*d* is formed into a curved shape swelling radially outward.

The first inner opening part 71*a* of the first opening 71 is arranged to face the volute internal flow channel 84. That part 56*a* of the first flow-channel recessed portion 56 which includes the first inner opening part 71*a* is disposed adjacent to the volute internal flow channel 84. The part 56*a* including the first inner opening part 71*a* will be hereinafter referred to as "first flow-channel inner recessed part 56*a*". Since the first inner opening part 71*a* is arranged to face the volute internal flow channel 84, the first inner flow-channel recessed part 56*a* communicates with the volute internal flow channel 84 via the first inner opening part 71*a*.

The first outer opening part 71*b* of the first opening 71 is located on the radial outer side of the volute internal flow channel 81 and closed by the first projecting part 91. That part 56*b* of the first flow-channel recessed portion 56 which includes the first outer opening part 71*b* is arranged to protrude from the volute internal flow channel 84 in a radial outward direction of the impeller 28. The part 56*b* including the first outer opening part 71*b* will be hereinafter referred to as "first outer flow-channel recessed part 56*b*". The first inner flow-channel recessed part 56*a* and the first outer flow-channel recessed part 56*b* communicate with each other and jointly form the first flow-channel recess portion 56 such that the first flow-channel recessed portion 56 is communicated with the volute internal flow channel 84 via the first inner opening part 71*a*.

As shown in FIGS. 5 and 6, the volute body 88 is formed spirally such that the outer peripheral wall 88*d* of the volute body 88 gradually separates outwardly from the inner peripheral wall 88*c* as it goes from the trailing end 88*a* toward the leading end 88*b*. The volute body 88 is formed such that the volute width W1 increases gradually in a direction from the trailing end 88*a* toward the leading end 88*b* of the volute body 88. Furthermore, the first and fourth flow-channel recessed portions 56-59 are arranged to locate on the same circumference of a circle, and the respective inner connecting sections 103*e*, 105, 106, 107 of the first to fourth flow-channel recessed portions 56-59 are spaced by a fixed distance L1 from the inner peripheral wall 88*c* of the volute body 88.

The outer peripheral wall 88*d* of the volute body 88 is outwardly offset to a greater extent from the first to fourth inner connecting sections 103*e*, 105, 106, 107 as it goes from the trailing end 88*a* to the leading end 88*b* of the volute body 88. The first flow-channel recessed portion 56 is located adjacent to the trailing end 88 of the volute body 88 so that the volute width W1 is controlled to have a small value at the first flow-channel recessed portion 56. With this arrangement, as shown in FIG. 7, the first outer opening part 71*b* is allowed to have a large area S1 and the first outer flow-channel recessed part 56*b* is also allowed to have a large capacity. Furthermore, since the inner end 103*c* of the upstream straight section 103*a* and the inner end of the upstream peripheral wall portion 99*a* are located adjacent to the outer periphery 81*a* of the hub 81, the opening width W2 of the first inner opening part 71*a* can be secured in a wide range H2 which is substantially equal to the entire width of the volute internal flow channel 84.

By thus securing the opening width W2 in the wide range H2, it is possible to appropriately introduce the prime fluid from the first inner opening part 71*a* into the internal space 101 of the first flow-channel recessed portion 56. Furthermore, the thus introduced prime fluid is able to appropriately generate a vortex flow within the internal space 101 of the first flow-channel recessed portion 56. The prime fluid in the volute internal flow channel 84 contains gas in the form of air bubbles. The prime fluid mixed with air bubbles has reduced viscosity and density so that the prime fluid can be easily introduced into the first inner flow-channel recessed part 56*a*.

The vortex flow generated within the internal space 101 of the first flow-channel recessed portion 56 promotes generation of air bubbles from the prime fluid and the air bubbles can be appropriately separated from the prime fluid. By thus separating the air bubbles from the prime fluid, the gas can be appropriately discharged from the volute internal flow channel 84 to the outside. The self-priming performance of the centrifugal pump can thus be improved.

If the upstream straight section 103*a* is replaced by a curved section, the upstream curved section will fail to introduce the prime fluid into the internal space 101 of the first flow-channel recessed portion uniformly over the entire width of the upstream curved section. More specifically, a part of the prime fluid tends to first flow into the internal space 101 of the first flow-channel recessed portion 56 and this prime fluid part is restrained from flowing into the internal space 101 of the first flow-channel recessed portion 56 due to, for example, the viscosity of that part of the prime fluid which tends to later flow into the internal space 101 of the first flow-channel recessed portion 56. It is therefore difficult to appropriately introduce the prime fluid from the first inner opening part 71*a* into the internal space 101 of the first flow-channel recessed portion 56.

By contrast, the upstream straight section 103*a* provided on the upstream side is able to secure uniform entry of the prime fluid into the internal space 101 of the first flow-channel recessed portion 56 over the width thereof. The prime fluid can thus be appropriately introduced from the first inner opening part 71*a* into the internal space 101 of the first flow-channel recessed portion 56. The thus introduced prime fluid can appropriately generate a vortex flow within the internal space 101 of the first flow-channel recessed portion 56.

The first outer flow-channel recessed part 56*b* of the first flow-channel recessed portion 56 is arranged to protrude from the volute internal flow channel 84 in a radial outward direction of the impeller 28. The prime fluid as it flows along the volute internal flow channel 84 is subjected to a centrifugal force. Under such condition, upon entry from the first inner opening part 71*a* into the first inner flow-channel recessed part 56*a*, the introduced prime fluid is guide into the first outer flow-channel recessed part 56*b* in the form of a vortex flow by the effect of the centrifugal force. This will promote generation of the vortex flow by the prime fluid, which will further promote generation of air bubbles from the prime fluid.

The first peripheral wall 99 of the first flow-channel recessed portion 56 has the outer peripheral wall portion 99*d* (FIG. 7) formed into a curved shape swelling radially outward. The thus curved outer peripheral wall portion 99*d* is able to further promote generation of the vortex flow by the prime fluid which is introduced into the first flow-channel recessed portion 56.

Referring back to FIG. 5, the second flow-channel recessed portion 57 is formed to be separated in a counterclockwise direction at a fixed interval from the first flow-channel recessed portion 56. Likewise the first flow-channel recessed portion 56, the second flow-channel recessed portion 57 is arranged such that the opening width W2 of the second inner opening part 72*a* can be secured in a wide range H3 which is substantially equal to the entire width of the volute internal flow channel 84. With this arrangement, the prime fluid can be appropriately introduced from the second inner opening part 72*a* into an internal space of the second flow-channel recessed portion 57 and the thus introduced prime fluid can appropriately generate a vortex flow.

The third flow-channel recessed portion 58 is formed to be separated in the counterclockwise direction at the fixed interval from the second flow-channel recessed portion 57. Likewise the first flow-channel recessed portion 56, the third flow-channel recessed portion 58 is arranged such that the opening width W2 of the third inner opening part 73*a* can be secured in a wide range H4 which is substantially equal to the entire width of the volute internal flow channel 84. This arrangement ensures that the prime fluid can be appropriately introduced from the third inner opening part 73*a* into an internal space of the third flow-channel recessed portion 58, and the thus introduced prime fluid can appropriately generate a vortex flow.

The fourth flow-channel recessed portion 59 is formed to be separated in the counterclockwise direction at the fixed interval from the third flow-channel recessed portion 58. Likewise the first flow-channel recessed portion 56, the fourth flow-channel recessed portion 59 is arranged such that the opening width W2 of the fourth inner opening part 74*a* can be secured in a wide range H5 which is substantially equal to the entire width of the volute internal flow channel 84. With this arrangement, the prime fluid can be appropriately introduced from the fourth inner opening part 74*a* into an internal space of the fourth flow-channel recessed portion 59, and the thus introduced prime fluid can appropriately generate a vortex flow. The second, third and fourth flow-channel recessed portions 57, 58 and 59 have shapes similar to the shape of the first flow-channel recessed portion 56 and a detailed description of these flow-channels 57-59 can be omitted.

Figure 9:
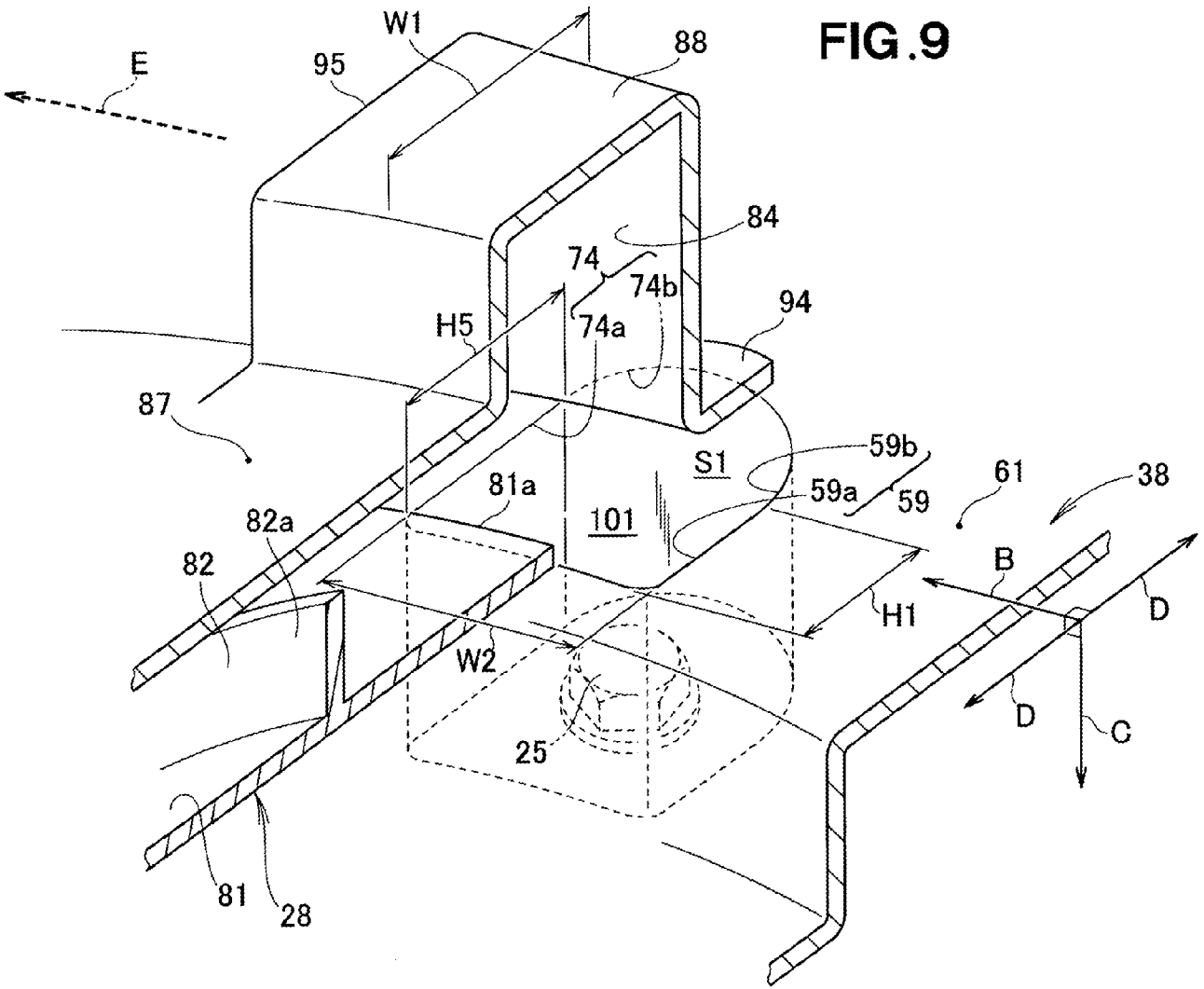
FIG. 9 is a perspective view showing the volute case and a fourth flow-channel recessed portion shown in FIG. 5.

As shown in FIGS. 5 and 9, the fourth flow-channel recessed portion 59 is formed to be located adjacent to the leading end 88*b* of the volute body 88. Since the volute width W1 of the volute body 88 is formed to increase gradually in a direction from the trailing end 88*a* toward the leading end 88*b* of the volute body 88, the volute width W1 at the fourth flow-channel recessed portion 59 is secured to have a large value. With this arrangement, the area S1 of the fourth outer opening part 74*b* is set to be small and a fourth outer flow-channel recess part 59*b* is also set to be small.

Because of the volute width W1 formed to be increase gradually from the trailing end 88*a* to the leading end 88*b* of the volute body 88, the area S1 of the second outer opening part 72*b* of the second flow-channel recessed portion 57 is smaller than the area S1 of the first outer opening part 71*b* of the first flow-channel recessed portion 56. That is, a second outer flow-channel recessed part 57*b* of the second flow-channel recessed portion 57 is configured to be smaller than the first outer flow-channel recessed part 56*b* of the first flow-channel recessed portion 56.

Furthermore, the area S1 of the third outer opening part 73*b* of the third flow-channel recessed portion 58 is smaller than the area S1 of the second outer opening part 72*b* of the second flow-channel recessed portion 57 and larger than the area S1 of the fourth outer opening 74*b* of the fourth flow-channel recessed portion 59. That is, a third outer flow-channel recessed part 58*b* of the third flow-channel recessed portion 58 is configured to be smaller than the second outer flow-channel recessed part 57*b* of the second flow-channel recessed portion 57 and larger than the fourth outer flow-channel recessed part 59*b* of the fourth flow-channel recessed portion 59.

As is apparent from the foregoing, the areas S1 of the first to fourth outer opening parts 71*b*-74*b* are set to be smaller successively along the direction of flow of the fluid, and the first to fourth outer flow-channel recess parts 56*b*-59*b* are set to be smaller successively along the direction of the fluid. With this arrangement, the first outer flow-channel recessed part 56*b* on the trailing end 88*a* side is secured to be sufficiently large, and the fourth outer flow-channel recessed part 59*b* on the leading end 88*b* side is reduced to be small. By thus providing the sufficiently large first outer flow-channel recessed part 56*b* on the trailing end 88*a* side of the volute body 88, the prime fluid is introduced into the first outer flow-channel recessed part 56*b* under the effect of a centrifugal force. This will promote generation of a vortex flow by the prime fluid (i.e., stirring of the prime fluid), which in turn promotes generation of air bubbles from the prime fluid.

On the other hand, since the fourth outer flow-channel recessed part 59*b* on the leading end 88*b* side of the volute body 88 is reduced to be small, the prime fluid is uneasy to enter the fourth outer flow-channel recessed part 59*b* by the effect of the centrifugal force so that the generation of a vortex flow by the prime fluid (i.e., stirring of the prime fluid) is suppressed. The prime fluid introduced to the leading end 88*b* side of the volute body 88 can be smoothly discharged from the volute discharge port 85 so that excellent prime-fluid discharging performance can be obtained.

Generation of the air bubbles from the prime fluid can thus be sufficiently promoted on the trailing end 88*a* side of the volute body 88, and the excellent prime-fluid discharging performance can be obtained on the leading end 88*b* side of the volute body 88. As a result, gas can be appropriately discharged from the interior of the volute body 88 (i.e., the volute internal flow channel 84) to the outside (i.e., the case internal flow channel 41) as indicated by arrow E, and a further improvement in the self-priming performance of the centrifugal pump can be achieved.

Furthermore, since the second outer flow-channel recessed part 57*b* of the second flow-channel recessed portion 57 is smaller than the first outer flow-channel recessed part 56*b*, generation of a vortex flow (i.e., stirring of the prime fluid) by the second outer flow-channel recessed part 57*b* is properly suppressed as compared to that by the first outer flow-channel recessed part 56*b*. Similarly, because the third outer flow-channel recessed part 58*b* of the third flow-channel recessed portion 58 is smaller than the second outer flow-channel recessed part 57*b*, generation of a vortex flow (i.e., stirring of the prime fluid) by the third outer flow-channel recessed part 58*b* is properly suppressed as compared to that by the second outer flow-channel recessed part 57*b*.

By thus providing the first to fourth flow-channel recessed portions 56-59 opening to the volute internal flow channel 84 and by stirring the prime fluid within the internal spaces 101 of the first to fourth flow-channel recessed portions 56-59, it is not necessary for stirring the prime fluid by the impeller 28 (especially by distal ends or outer circumferential ends 82*a*) of the vanes 82. The distal ends 82*a* of the vanes 82 are allowed to be formed into a shape which is suitable for a discharge amount of the fluid during the steady operation.

As shown in FIG. 8, the first flow-channel recessed portion 56 is in the form of a blind hole which is closed at the bottom 98 and opens at the first opening 71. During the steady operation, the internal space 101 of the first flow-channel recessed portion 56 is kept in the state of being filled with the fluid, making it difficult for the fluid to flow into the internal space 101 of the first flow-channel recessed portion 56. The fluid can thus be smoothly guided along the volute internal flow channel 84.

As shown in FIG. 5, the second to fourth flow-channel recessed portions 57-59 are also in the form of blind holes in the same manner as the first flow-channel recessed portion 56. Thus, during the steady operation, the internal spaces of the second and fourth flow-channel recessed portions 57-59 are kept in the state of being filled with the fluid. This arrangement hinders further entry of the fluid into the internal spaces of the second to fourth flow-channel recessed portions 57-59. The fluid can thus be smoothly guided along the volute internal flow channel 84. Since the vanes 82 are allowed to have distal ends 82*a* so shaped as to be suitable for the steady operation, and since the fluid can smoothly flow during the steady operation, a desired pumping efficiency during the steady operation can be suitably obtained.

Next, a self-priming operation of the centrifugal pump 20 will be described with reference to FIGS. 10 to 13. As shown in FIG. 10A, when the impeller 28 of the centrifugal pump 28 is in a stop state, gas (for example, air) is reserved inside the internal space 63 of the volute case 29. In this condition, the supply plug 48 is removed from the fluid supply port 47 as indicated by arrow F to thereby open the fluid supply port 47. While the fluid supply port 47 is in an open state, a prime fluid 112 is supplied from the fluid supply port 47 into the interior (i.e., the case internal flow channel 41) of the case member 27 as indicated by arrow G.

Figure 10B:
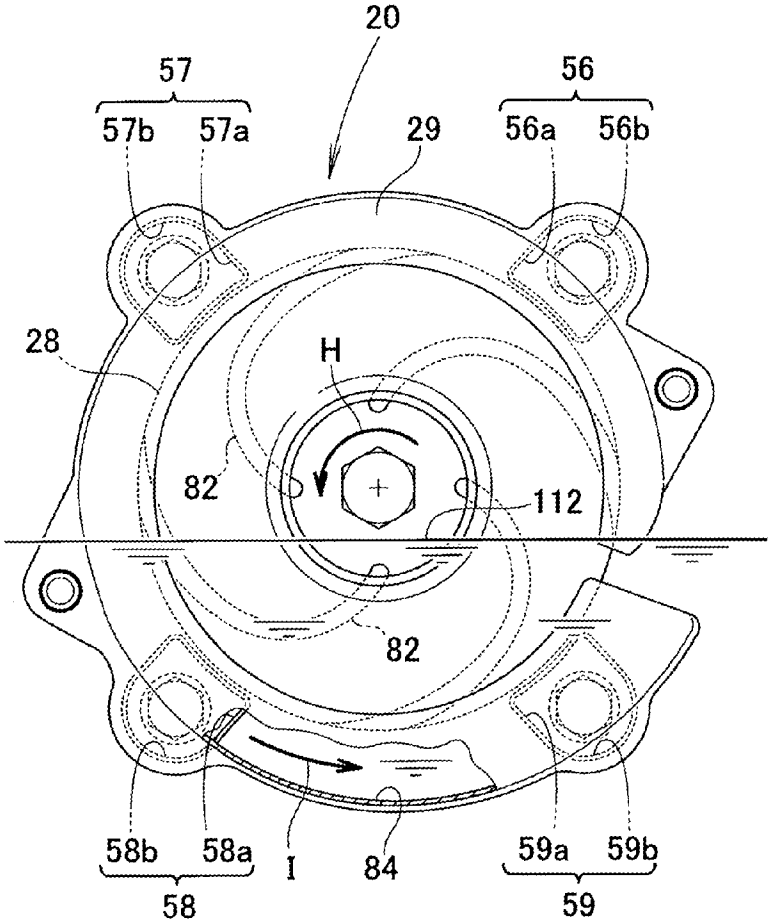
FIGS. 10A and 10B are views illustrative of the manner in which air inside a volute internal flow channel of the centrifugal pump unit is entrained in a prime fluid in a state of air bubbles.
Figure 10A:
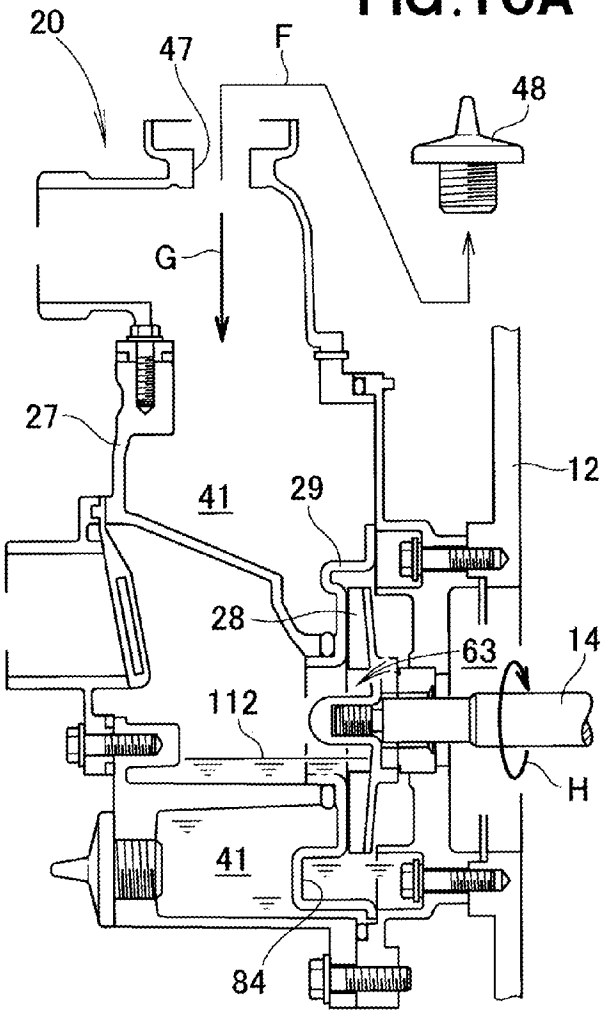

As shown in FIG. 10B, the prime fluid 112 supplied to the internal flow channel 41 of the case member 27 is reserved in the volute internal flow channel 84 via the internal flow channel 41. In this condition, the centrifugal pump 20 is driven by the engine 12 (FIG. 10A) to rotate the impeller 28 as indicated by arrow H. Rotation of the impeller 28 causes the prime fluid 112 to flow through the volute internal flow channel 84 as indicated by arrow I whereupon the gas in the volute internal flow channel 84 is entrained with the prime fluid in the form of air bubbles.

Figure 11A:
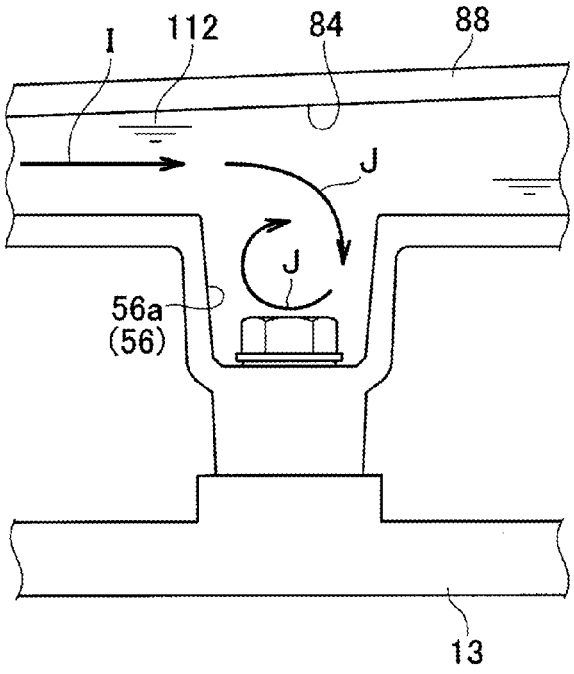
FIGS. 11A and 11B are views illustrative of the manner in which generation of a vortex flow by the prime fluid is promoted at the first to fourth flow-channel recessed portions.

As shown in FIG. 11A, due to the gas in the volute internal flow channel 84, which is now contained in the prime fluid 112 in the form of air bubbles, the viscosity and density of the prime fluid 112 are reduced. As a result, the prime fluid 112 can be easily introduced into the respective inner flow-channel recessed parts 56*a*-59*a* of the first to fourth flow-channel recessed portions 56-59 as indicated by arrow J shown in FIG. 10B.

Figure 11B:
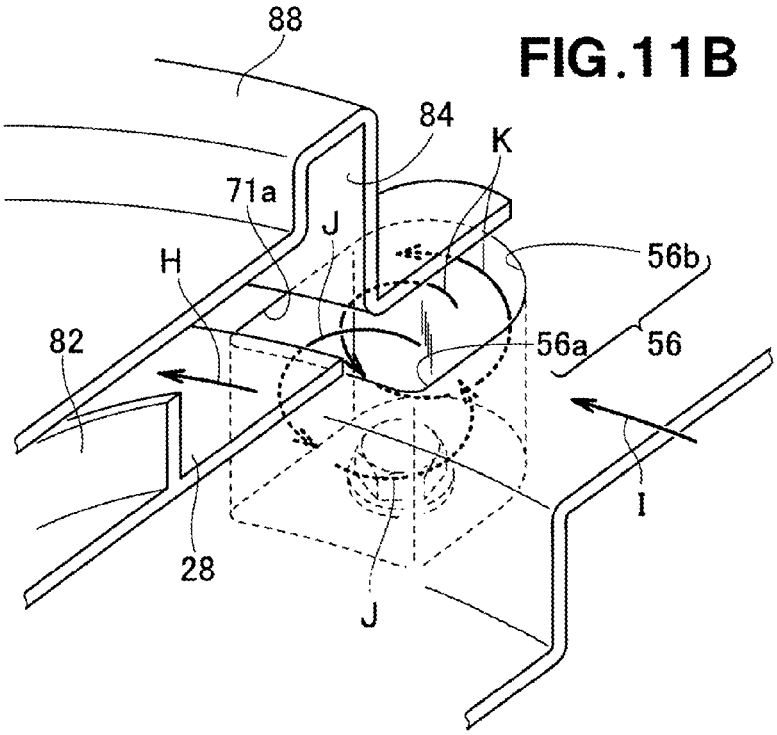

As shown in FIG. 11B, the first outer flow-channel recessed part 56*b* of the first flow-channel recessed portion 56 is arranged to protrude from the volute internal flow channel 84 in the radial outward direction of the impeller 28. Furthermore, the prime fluid 112 as it flows along the volute internal flow channel 84 is subjected to a centrifugal force acting in the radial outward direction of the impeller 28. Under such condition, upon entry from the first inner opening part 71*a* into the first inner flow-channel recessed part 56*a*, the prime fluid 112 is guided into the first outer flow-channel recessed part 56*b* in the form of a vortex flow by the effect of the centrifugal force as indicated by arrow K. In the first flow-channel recessed portion 56, generation of the vortex flow by the prime fluid 112 is promoted and generation of air bubbles from the prime fluid 112 is also promoted. The prime fluid 112, which has promoted the generation of air bubbles, is then introduced from the first flow-channel recessed portion 56 into the volute internal flow channel 84.

When introduced into each of the second to fourth inner flow-channel recessed parts 57*a*-59*a* shown in FIG. 10B, the prime fluid 112 will be guided into a corresponding one of the second to fourth outer flow-channel recessed parts 57*b*-59B in the form of a vortex flow by the effect of a centrifugal force, in the same manner as the prime fluid 112 introduced into the first inner flow-channel recessed part 56*a*. In the second to fourth flow-channel recessed portions 57-59, generation of the vortex flow by the prime fluid 112 is promoted and generation of air bubbles from the prime fluid 112 is also promoted.

Figure 12A:
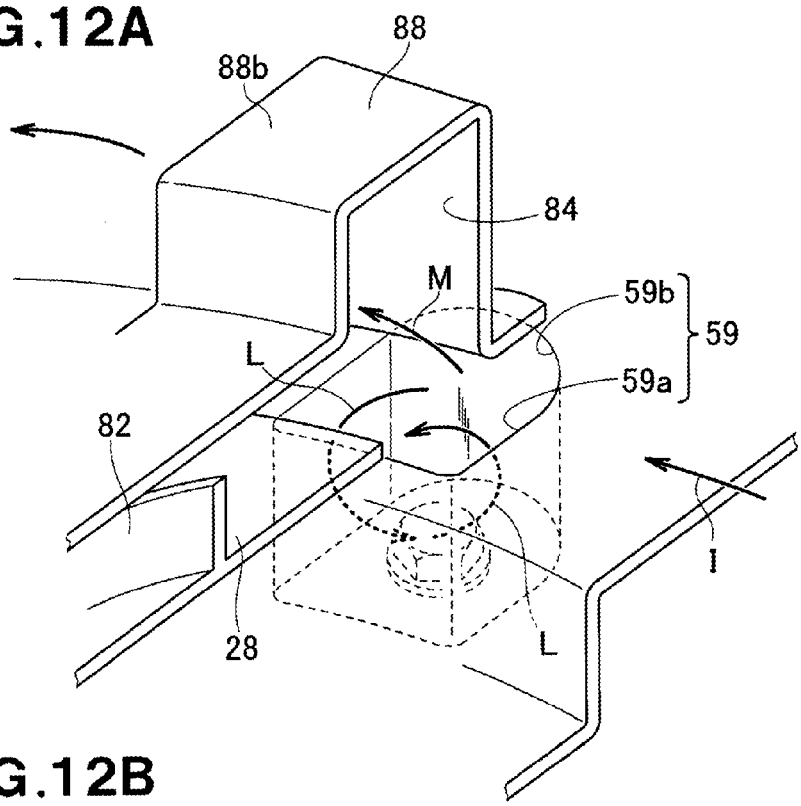
FIGS. 12A and 12B are views illustrative of the manner in which the prime fluid and air bubbles are discharged from a volute discharge port of a volute body.

As shown in FIG. 12A, the prime fluid 112 is introduced into the fourth inner flow-channel recessed part 59*a* of the fourth flow-channel recessed portion 59 as indicated by arrow L. In this instance, since the fourth outer flow-channel recessed part 59*b* of the fourth flow-channel recessed portion 59 is set to be small, the prime fluid 112 introduced in the fourth inner flow-channel recessed part 59*a* is not easily guided into the forth outer flow-channel recessed part 59*b* by the effect of the centrifugal force. As a result, generation of a vortex flow by the prime fluid 112 (i.e., stirring of the prime fluid 112) within the fourth flow-channel recessed portion 59 can be appropriately suppressed. The prime fluid 122 which has promoted generation of air bubbles will be introduced from the fourth flow-channel recessed portion 59 into the volute internal flow channel 84 as indicated by arrow M.

Figure 12B:
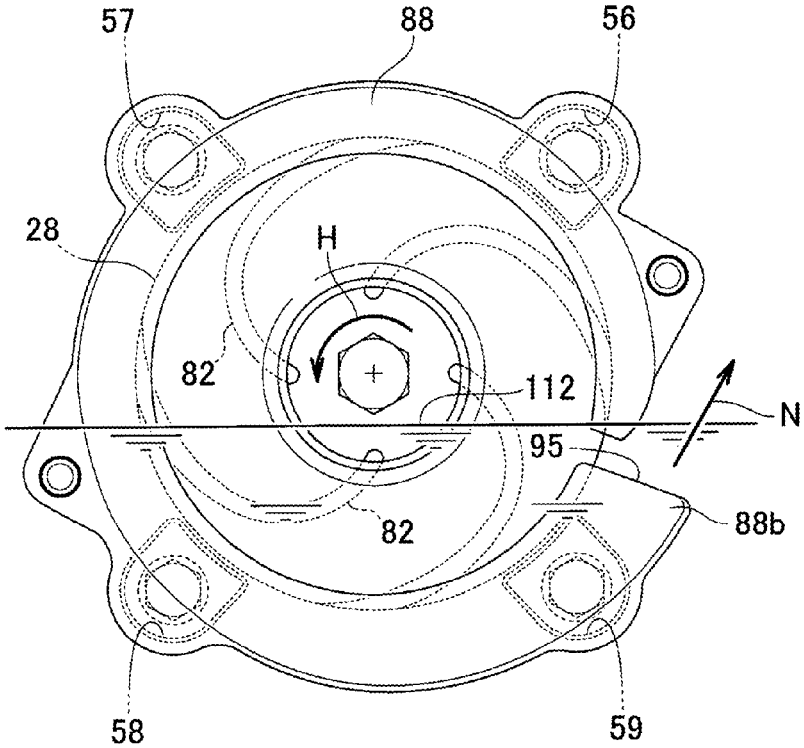

As shown in FIG. 12B, by virtue of the appropriately controlled vortex-flow generation in the internal space of the fourth flow-channel recessed portion 59, the prime fluid 112 and the air bubbles can be smoothly guided to the leading end 88*b* of the volute body 55. The prime fluid 112 and the air bubbles (i.e., the gas) thus guided to the leading end 88*a* of the volute body 88 can be appropriately discharged from the volute discharge port 95 as indicated by arrow N.

Figure 13B:
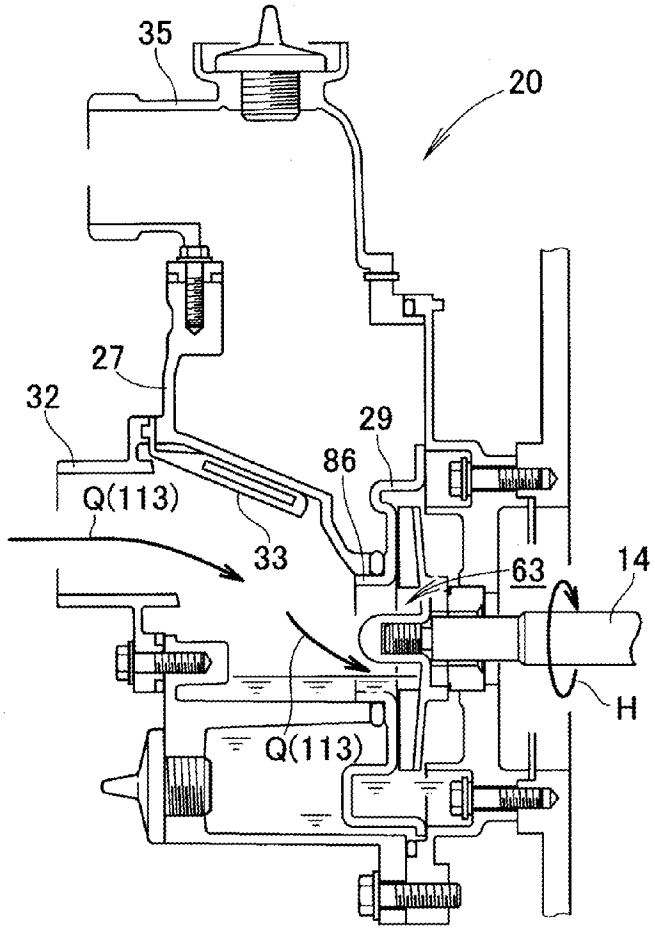
FIGS. 13A and 13B are views illustrative of the manner in which a self-priming operation of the centrifugal pump unit is completed.
Figure 13A:
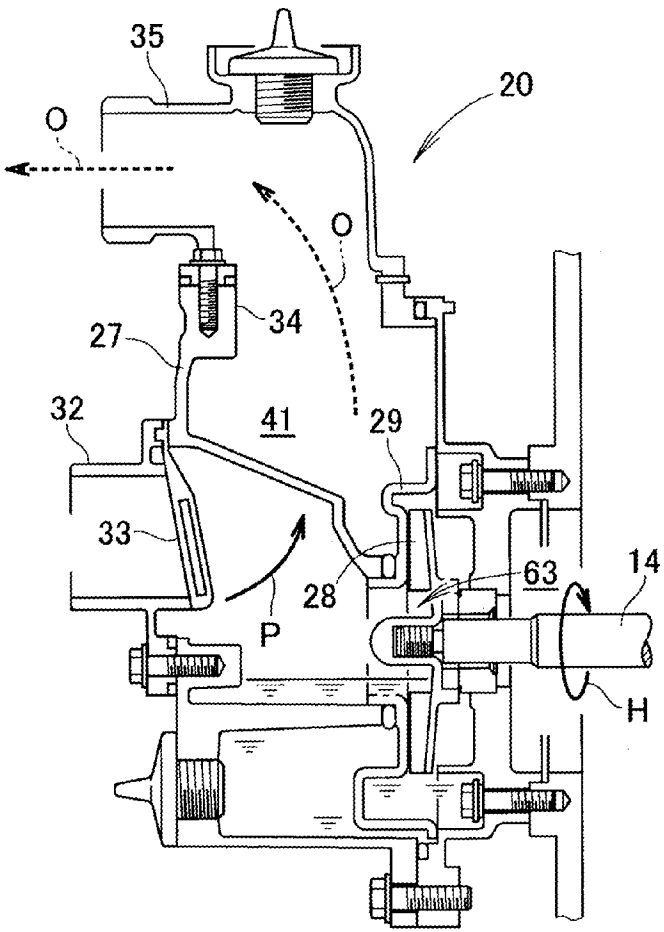

As shown in FIG. 13A, the gas discharged from the volute discharge port 95 (FIG. 12B) is then discharged to the outside of the centrifugal pump 20 successively through the case internal flow channel 41, the discharge port 34 and the discharge nozzle 35 as indicated by arrow O. By thus discharging the gas, a negative pressure is developed within the internal space 63 of the volute case 29, which will cause the opening and closing valve 33 to open as indicated by arrow P.

As shown in FIG. 13B, opening of the opening and closing valve 33 ensures a suction performance by which a fluid 113 is sucked from the volute suction port 86 into the internal space 63 of the volute case 29 as indicated by arrow Q. By thus achieving the suction performance, the centrifugal pump 20 completes the self-priming operation.

Next, the steady operation of the centrifugal pump 20 will be described with reference to FIGS. 14 to 16. As shown in FIG. 14A, after the self-priming operation is completed, the impeller 28 continues to rotate as indicated by arrow H. In this instance, the impeller 28 (especially the distal ends 82*a* of the vanes 82) is formed into a shape which is suitable for the steady operation. The internal space 63 of the volute case 29 communicates with the suction nozzle 34 via the volute suction port 86, the suction passage 44 and the case suction port 31.

With this arrangement, due to a negative pressure created in the internal space 63 of the volute case 29, the fluid 113 for the steady operation is sucked into the suction nozzle 32, the case suction port 31, the suction passage 44 and the volute suction port 86 successively, as indicated by arrow Q. The fluid 113 sucked into the volute suction port 86 is subsequently introduced into the volute internal flow channel 84 of the volute case 29.

Figure 14B:
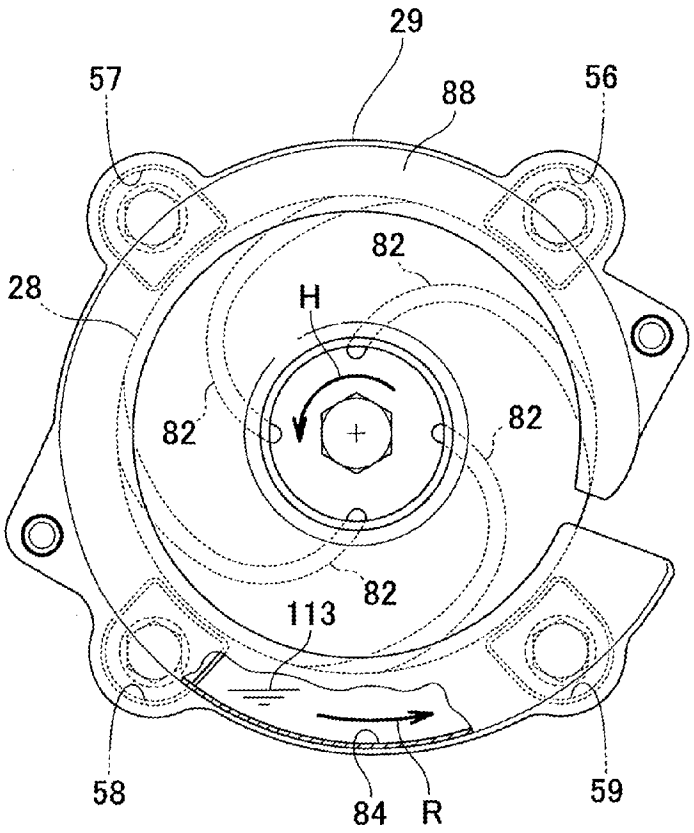
FIGS. 14A and 14B are views illustrative of the manner in which a fluid is guided into the volute internal flow channel and caused to flow in a rotating direction of the impeller.
Figure 14A:
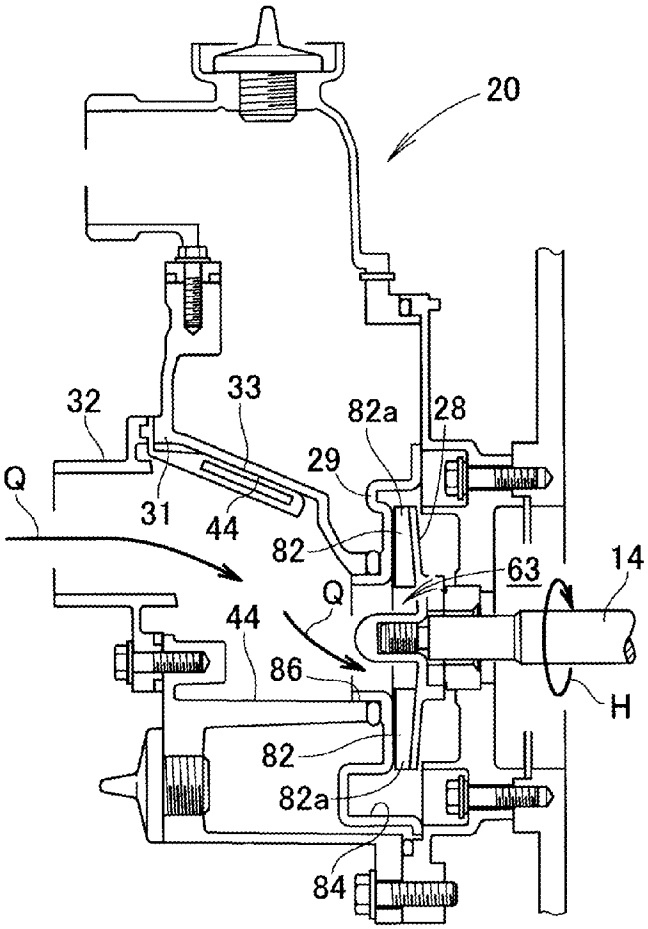

As shown in FIG. 14B, the fluid 113 introduced in the volute internal flow channel 84 is guided by the vanes 82 of the impeller 28. The fluid 82 while being guided by the vanes 82 flows in a rotating direction of the impeller 28 as indicated by arrow R.

Figure 15A:
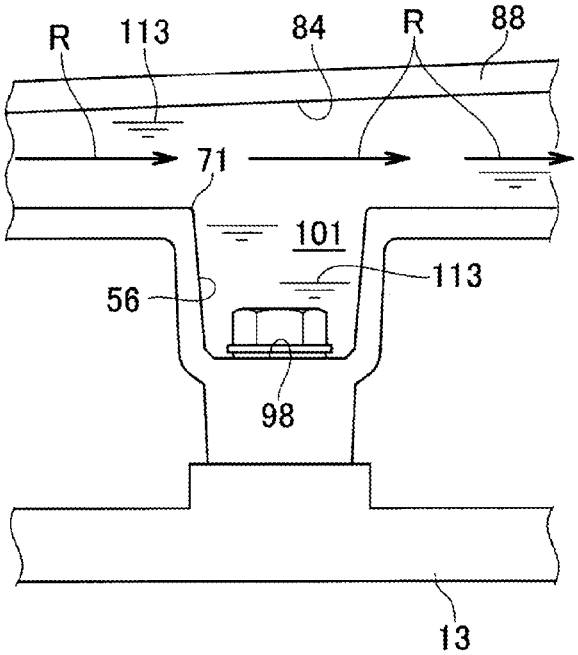
FIGS. 15A and 15B are views illustrative of the manner in which the fluid is discharged from the volute discharge port of the volute body.

As shown in FIG. 15A, the first flow-channel recessed portion 56 is in the form of a blind hole which is closed at the bottom 98 and opens at the first opening 71. With this arrangement, the internal space 101 of the first flow-channel recessed portion 56 is kept in the state of being filled with the fluid 113, hindering further entry of the fluid 113 from the volute internal flow channel 84 into the internal space 101 of the first flow-channel recessed portion 56.

Figure 15B:
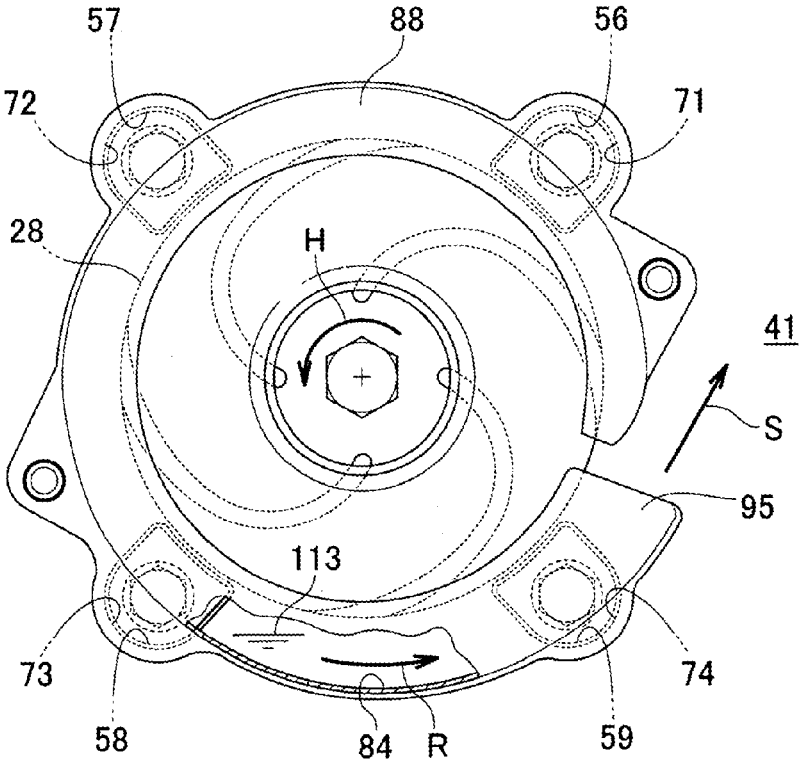

As shown in FIG. 15B, each of the second to fourth flow-channel recessed portions 57-59 is also in the form of a blind hole which is closed at the bottom and opens at a corresponding one of the second to fourth openings 72-74 in the same manner as the first flow-channel recessed portion 56. Thus, the internal spaces of the second and fourth flow-channel recessed portions 57-59 are kept in the state of being filled with the fluid 113.

By thus keeping the first to fourth flow-channel recessed portions 56-59 in the state of being filled with the fluid 113, it is possible to hinder entry of the fluid 113 from the volute internal flow channel 84 into the internal spaces of the first to fourth flow-channel recessed portions 56-59. The fluid 113 is therefore allowed to smoothly flow along the volute internal flow channel 84 as indicated by arrow R until it reaches the volute discharge port 95, and subsequently the fluid 113 is discharged from the volute discharge port 95 to the case internal flow channel 41 as indicated by arrow S.

Figure 16:
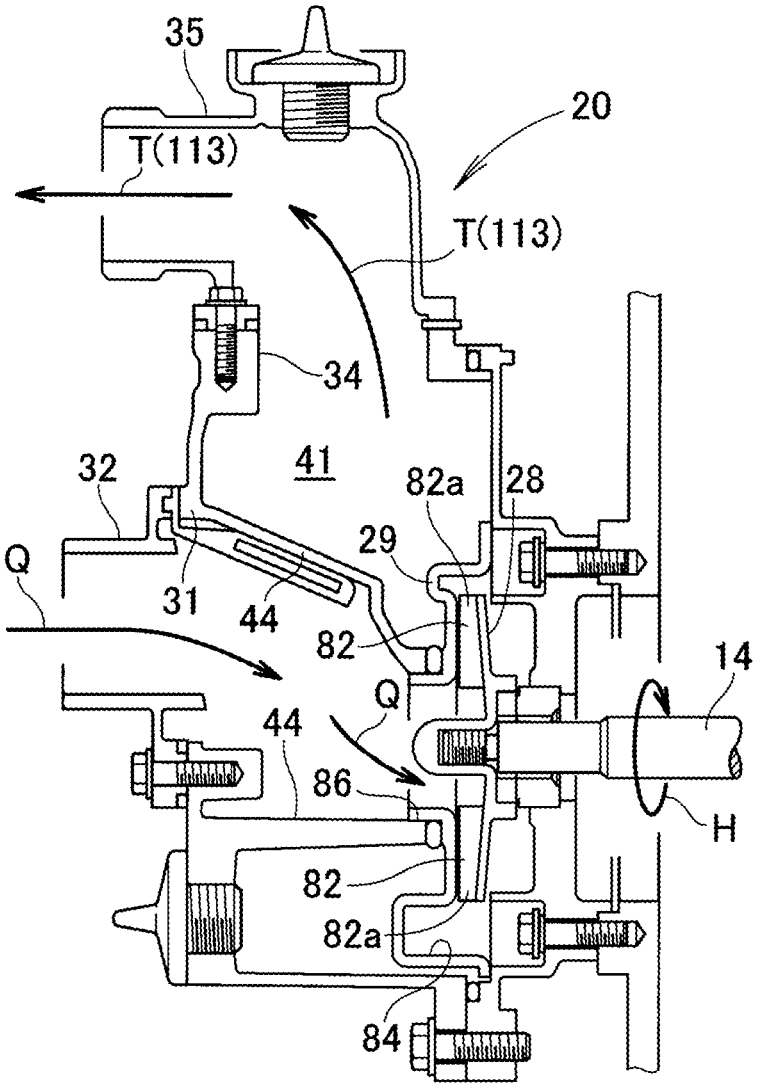
FIG. 16 is a view illustrative of the manner in which the fluid discharged into a case internal passage is discharged to the outside of the centrifugal pump unit according to the invention.

As shown in FIG. 16, the fluid 113 discharged into the case internal flow channel 41 is subsequently discharged to the outside of the centrifugal pump 20 successively through the case discharge port 34 and the discharge nozzle 35 as indicated by arrow T. Since the distal ends 82 of the vanes 82 are so shaped as to be suitable for the steady operation, and since the fluid 113 is allowed to smoothly flow through the volute internal flow channel 84, a desired pumping efficiency can be securely obtained.

The centrifugal pump according to the present invention should by no means be limited to the one discussed in the afore-mentioned embodiment, and various changes and modifications are possible. For example, in the illustrated embodiment, the first to fourth peripheral edges 103 (only the first peripheral edge being shown) each have both of the upstream straight section 103*a* and the downstream straight section 103*b*, however, only one of the upstream and downstream straight sections 103*a*, 103*b* may be provided.

In this case, it is preferable to provide the upstream straight section 103*a* because the prime fluid can be appropriately introduced from the upstream straight section 103*a* to the internal space of each of the first to fourth flow-channel recessed portions 56-59 (the internal space 101 of the first flow-channel recessed portion 101 being only shown). This arrangement ensures that a vortex flow of the prime fluid 112 can be appropriately generated within the internal spaces of the first to fourth flow-channel recessed portions 56-59.

Although in the illustrated embodiment, the peripheral edges of the first to fourth flow-channel recessed portions 56-59 (the first peripheral edge 103 being only shown) is formed into a portal arch shape, other shapes such as a substantially oblong shape, a substantially rectangular shape, etc. can be employed for the peripheral edges of the first to fourth flow channel recessed portions 56-59.

Furthermore, in the illustrated embodiment, the first to fourth flow-channel recessed portions 56-59 are formed by utilizing that parts of the case member 27 which are bolted by the first to fourth bolts 22-25. According to the invention, the first to fourth flow-channel recessed portions 56-59 can be formed without using the bolted parts of the case member 27.

Although in the illustrated embodiment, four flow-channel recessed portions (i.e., the first to fourth flow-channel recessed portions 56-59) are provided, the number of the flow-channel recessed portions can be properly selected.

Furthermore, the shape and configuration of the centrifugal pump unit, the centrifugal pump, the impeller, the volute case, the first to fourth flow-channel recessed portions, the first to fourth outer flow-channel recessed parts, the first to fourth openings, the volute internal flow channel, the volute body, the first peripheral edge, and the upstream and downstream straight sections should by no means be limited to those shown in the illustrated embodiment but can be changed appropriately.

The present invention is particularly suitable for an application to a centrifugal pump configured to force a fluid to flow along a volute internal flow channel upon rotation of an impeller disposed in a volute case.

Obviously, various minor changes and modifications of the present invention are possible in light of the above teaching. It is therefore to be understood that within the scope of the appended claims the invention may be practiced otherwise than as specifically described.

What is claimed is:

1. A centrifugal pump comprising:

a volute case having a volute internal flow channel formed therein;

an impeller rotatably disposed in the volute case for forcing a fluid to flow along the volute internal flow channel; and at least two flow-channel recessed portions opening to the volute internal flow channel and formed so as to be recessed in a direction orthogonal to a direction of flow of the fluid, wherein respective parts of the at least two flow-channel recessed portions are successively smaller along the direction of flow of the fluid, each of the respective parts protruding from the volute internal flow channel in a radial outward direction of the impeller.

2. The centrifugal pump according to claim 1, wherein the at least two flow-channel recessed portions each have an opening facing the volute internal flow channel, and a peripheral edge defining the opening, the peripheral edge having a straight section orthogonal to the direction of flow of the fluid.

* * * * *